US012281455B2

(12) United States Patent
Aslimoski

(10) Patent No.: US 12,281,455 B2
(45) Date of Patent: Apr. 22, 2025

(54) FOUNDATION FORMING ARRANGEMENT

(71) Applicant: PHALANGA PTY LTD, New South Wales (AU)

(72) Inventor: Jason Aslimoski, Jerrabomberra (AU)

(73) Assignee: PHALANGA PTY LTD, Queanbeyan (AU)

( * ) Notice: Subject to any disclaimer, the term of this patent is extended or adjusted under 35 U.S.C. 154(b) by 0 days.

(21) Appl. No.: 17/957,702

(22) Filed: Sep. 30, 2022

(65) Prior Publication Data

US 2023/0028187 A1 Jan. 26, 2023

Related U.S. Application Data

(63) Continuation of application No. PCT/AU2021/050315, filed on Apr. 6, 2021.

(30) Foreign Application Priority Data

Apr. 2, 2020 (AU) ..... 2020901029

(51) Int. Cl.
*E02D 27/01* (2006.01)
*E02D 27/08* (2006.01)

(52) U.S. Cl.
CPC ..... *E02D 27/013* (2013.01); *E02D 27/08* (2013.01); *E02D 2250/0007* (2013.01);
(Continued)

(58) Field of Classification Search
CPC combination set(s) only.
See application file for complete search history.

(56) References Cited

U.S. PATENT DOCUMENTS 4,783,935 A 11/1988 Creager
4,788,809 A * 12/1988 Koukourou ..... E04B 5/326 52/741.15

(Continued)

FOREIGN PATENT DOCUMENTS

GB 2522886 A 8/2015
KR 20190096744 A 8/2019

(Continued)

OTHER PUBLICATIONS

International Search Report issued for International Patent Application No. PCT/AU2021/050315, mailed on Apr. 30, 2021.

(Continued)

*Primary Examiner* — Kyle Armstrong
(74) *Attorney, Agent, or Firm* — Myers Wolin, LLC

(57) ABSTRACT

A foundation forming arrangement is provided for forming a foundation slab. The foundation forming arrangement includes at least one side forming member for forming a side of the foundation slab. The foundation forming arrangement further includes at least one connector that is configured for coupling the side forming members to either a reinforcing steelwork or a forming pod. The foundation forming arrangement can further include a drain, as well as an insulative panel. The foundation forming arrangement can include a forming pod that is configured for connection to the side forming members. The foundation forming arrangement can include securing arrangements for securing the connectors to the top or the base of a forming pod.

5 Claims, 26 Drawing Sheets

(52) U.S. Cl.
CPC ..... *E02D 2250/0023* (2013.01); *E02D 2300/002* (2013.01); *E02D 2600/20* (2013.01)

(56) References Cited

U.S. PATENT DOCUMENTS

| | | | | |
|---|---|---|---|---|
| 5,694,723 | A * | 12/1997 | Parker | E02D 27/32 404/4 |
| 5,771,643 | A * | 6/1998 | Parker | E02D 27/32 52/302.1 |
| 8,011,144 | B2 | 9/2011 | Compton | |
| 9,694,511 | B2 * | 7/2017 | Sladojevic | B28B 7/0017 |
| 11,808,030 | B1 * | 11/2023 | McPherson | E04B 1/70 |

FOREIGN PATENT DOCUMENTS

| | | | |
|---|---|---|---|
| WO | 2012/053021 | A1 | 4/2012 |
| WO | 2020/165877 | A1 | 8/2020 |

OTHER PUBLICATIONS

Written Opinion of the International Preliminary Examining Authority issued for International Patent Application No. PCT/AU2021/050315, mailed on May 24, 2022.
Grano Direct, "Con-Form Flexible Boards", published 2018, Retrieved from the Internet Oct. 15, 2024, URL https://www.granodirect.com.au/formwork/pvc-formwork/con-form/con-form-flexible-boards.
Con-Form Concrete Formwork Systems; Fibreform boards, Retrieved from the Internet Oct. 15, 2024, URL: https://www.con-form.com.au/#gohere.
Multi Slab Brace Formwork, Retrieved from the Internet Oct. 15, 2024, URL: https://msbform.com/.
Energyedge, Published 2021, Retrieved from the Internet Oct. 15, 2024, URL: https://www.eeform.com/concrete-edge-products.
A.G. Pulie, Retrieved from the Internet Oct. 15, 2024, URL: https://www.agpulie.com.au/products/category/YWXDVGMV-accessories.
Quickset; Innovative formwork for future construction, Retrieved from the Internet Oct. 15, 2024, URL: https://quickset.co.nz/.
Grano Direct, "Pathform", Published 2018, Retrieved from the Internet Oct. 15, 2024, URL: https://www.granodirect.com.au/formwork/pvc-formwork/path-form/pathform.
Ezyform International, Retrieved from the Internet Oct. 15, 2024, URL:https://www.ezyforminternational.com.au/.
Flexiform Solutions, Retrieved from the Internet Oct. 15, 2024, URL: https://flexiform.com.au/.
Completehome, "Aluminum Formwork: the perfect new build solution (AL-Edge System)", Published 2020 by Universal Media; Retrieved from the Internet Oct. 15, 2024, URL: https://www.completehome.com.au/renovations/aluminium-formwork-new-build.html.
EZ Form LLC, "Mono Slab", Published 2024, Retrieved from the Internet Oct. 15, 2024, URL: https://monoslabezform.com/.
K-Form Concrete Formwork Systems, Retrieved from the Internet Oct. 15, 2024, URL: http://kform.co.uk/.
Masterform Systems, "Innovative Rapid Rebate and Setdown Formwork Products", Published Oct. 27, 2023, Retrieved from the Internet Archive Oct. 15, 2024, URL: https://web.archive.org/web/20231027214046/https://www.masterform.com.au/formwork-products/setdown-form-rapid-rebates/.
Stego, "Beast Form Stake", Published 2024 by Stego Industries, Retrieved from the Internet Oct. 15, 2024, URL: https://www.stegoindustries.com/products/beast-form-stake.
Biax Foundations, "Foundations for a Greener Tomorrow", Published 2024, Biax; Retrieved from the Internet Oct. 15, 2024, URL: https://www.biax.com.au/.
ARC, LOK-POD, Retrieved from the Internet Oct. 15, 2024, URL: https://www.lokpod.com.au/.
Firth, "Ribraft X-Pod", Retrieved from the Internet Oct. 15, 2024, URL: https://www.firth.co.nz/concrete/foundations/xpod/.
QPOD Earth-Friendly Foundations, "Introducing the pod foundation system that's easy to install and easy on the planet too", QPOD, NZ, Retrieved from the Internet Oct. 15, 2024, URL: https://www.qpod.nz/.
Cornell, Matthew; "Beware Waffle Slabs", Smarter Structural Engineering, Published Apr. 16, 2014 by Cornell Engineers, Retrieved from the Internet Oct. 15, 2024, URL: https://cornellengineers.com.au/beware-waffle-slabs/.

* cited by examiner

FOUNDATION FORMING ARRANGEMENT

CROSS REFERENCE TO RELATED APPLICATIONS

This application is a continuation of International Application No. PCT/AU2021/050315, filed Apr. 6, 2021, which takes priority from Australian Provisional Patent Application No. 2020901029, filed Apr. 2, 2020, the entire contents of each of which are incorporated by reference herein.

TECHNICAL FIELD

The present invention relates to a foundation forming arrangement, and in particular to a foundation forming arrangement for facilitating the pouring of a foundation slab.

The invention has been developed primarily for use in/with the pouring of a foundation slab and will be described hereinafter with reference to this application. However, it will be appreciated that the invention is not limited to this particular field of use.

BACKGROUND

At present when foundation slabs are poured, for example for a residential housing development, the area of the foundation slab is marked out. Posts are then inserted into the ground around the periphery of the intended slab, after which formwork boards or planks are nailed to the posts.

Reinforcing steelwork is typically laid out within the marked out foundation slab area. Forming pods may also be laid out within the marked out foundation slab area in order to provide voids underneath the concrete slab once it has set.

The setting up a formwork that defines the sides of the foundation slab is typically time-consuming and labour-intensive as it is required to be robust.

The present invention seeks to provide a or foundation forming arrangement, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY

According to a first aspect, the present invention may be said to consist in a foundation forming arrangement for forming the side of a foundation slab, the foundation forming arrangement comprising:

a. at least one or more side forming members; and b. at least one or more connectors configured for coupling the at least one or more side forming members to one or more selected from i. reinforcing steelwork; and ii. a forming pod.

In one embodiment, the at least one or more side forming members include at least one or more upper side forming member and at least one or more lower side forming members.

In one embodiment, at least one or both of the at least one or more upper side forming members and the at least one or more lower side forming member are L-shaped.

In one embodiment, at least one or both of the at least one or more upper side forming members and the at least one or more lower side forming members include at least one or more connecting formations for connecting to the at least one or more connectors.

In one embodiment, the at least one or more connectors are configured for coupling at least one or more lower side forming member to at least one or more upper side forming member.

In one embodiment, the at least one or more connectors includes a support formation for supporting at least one or more upper side forming members off the ground.

In one embodiment, the at least one or more connectors include at least one or more pod connecting formations for connecting the connector to the forming pod.

In one embodiment, the at least one or more connectors include lower connecting formations for connecting to at least one or more lower side forming members.

In one embodiment, the at least one or more connectors include upper connecting formation for connecting to at least one or more upper side forming members.

In one embodiment, the pod connecting formation is a sliding engageable member configured for sliding engagement with a slot in the forming pod.

The foundation forming arrangement includes at least one or more forming pods.

In one embodiment, the forming pods include connector formations configured for connecting to the at least one or more connectors.

In one embodiment, the lower connecting formations are snap-fit type formations.

In one embodiment, the lower connecting formation are sliding formations

In one embodiment, the upper connecting formations are sliding formations.

In one embodiment, the at least one or more lower side forming members include a zone of engineered weakness for removal of a removable portion.

In one embodiment, the at least one or more upper side forming members include a zone of engineered weakness for removal of a removable portion.

In one embodiment, one or more selected from the upper connecting formation on the lower connecting formation is a tether.

In one embodiment, the tether is integrally formed with the connector.

In one embodiment, one or more selected from the upper connecting formation and the lower connecting formation includes a tether receiver.

In one embodiment, the tether includes teeth formations, and the tether receiver includes a ratchet mechanism.

In one embodiment, the connector is configured for attachment to a plurality of forming pods.

In one embodiment, the connector is configured for providing spacing formations for spacing the plurality of forming pods.

In one embodiment, the connector is configured for supporting a plurality of reinforcing bars extending at right angles to each other.

In one embodiment, the connectors configured for supporting at least one or more reinforcing bars extending over the top of the forming pods.

In one embodiment, the pod connecting formation is configured for connecting to an underside of the pod.

In one embodiment, the pod connecting formation includes a flat plate.

In one embodiment, the pod connecting formation includes piercing formations for piercing the forming pod.

In one embodiment, the foundation forming arrangement further includes a secondary connector.

In one embodiment, the secondary connector is configured for connecting an upper side forming member to reinforcing steelwork.

In one embodiment, the secondary connector includes complementary at least one connecting formation for connecting to the upper side forming member.

In one embodiment, the secondary connector includes at least one or more complementary connecting formations for connection to reinforcing bars.

In one embodiment, the foundation forming arrangement includes a drain that defines a drainage passage for diverting groundwater from the foundation slab.

In one embodiment, the drain is configured for being connected to one or more selected from the connector and the side forming member.

In one embodiment, the drain includes connector formations for connecting to one or more selected from the connector and the side forming member.

In one embodiment, the drain includes a drainage channel.

In one embodiment, the drainage channel is U-shaped.

In one embodiment, the drainage channel is enclosed.

In one embodiment, the drainage channel is perforated.

In one embodiment, the drainage channel includes a grate configured for filtering groundwater from the surrounding soil.

In one embodiment, the grate is removably attachable to the drainage channel.

In one embodiment, the drain is configured for connection to a stormwater drain pipe.

In one embodiment, the drain includes a stormwater connection outlet.

In one embodiment, the stormwater connection outlet is located on a side of the drainage channel.

In one embodiment, the foundation forming arrangement includes an insulative panel configured for insulating the side of the foundation slab once poured.

In one embodiment, the insulative panel is integrally formed with the side forming member.

In one embodiment, the insulative panel is integrally formed with the one or both of the upper side forming member and the lower side forming member.

In one embodiment, the insulative panel is composed of insulative material, the insulative material including one or more selected from:

a. expanded foam, b. plastic, c. timber, and d. any other suitable material.

In one embodiment, the side forming member includes a slot for receiving double sided tape along an inner side of its length.

In one embodiment, the foundation forming arrangement includes double sided tape extending along an inner portion of the length of the side forming member.

In one embodiment, the double sided tape is configured for sticking to a planar plastic moisture barrier.

In one embodiment, the side forming member defines a ridge along its length on an inner side, the ridge being engageable by clips in a snap fit arrangement, the ridge and clips being configured to hold a thin film plastic moisture barrier between them.

According to a further aspect, the present invention may be said to consist in a connector for connecting a side forming member to one or more selected from reinforcing steelwork and a forming pod, the connector comprising:

a. a connector body configured for extending between the side forming member and one or more selected from reinforcing steelwork and a forming pod to hold it together.

In one embodiment, the connector includes reinforcing bar support formation is for supporting the reinforcing steelwork at a height above the ground.

In a one embodiment, the connector includes a support formation.

In one embodiment, the support formation is a support leg.

In one embodiment, the connector includes at least one or more pod connecting formations configured for connecting with complementary connecting formations on the forming pod.

In one embodiment, the connector includes at least one or more side member connecting formations configured for engaging with a side forming member.

In one embodiment, the connector includes at least one or more upper side member connecting formations for connecting to an upper side forming member.

In one embodiment, the connector includes at least one or more lower side member connecting formation for connecting to a lower side forming member.

In one embodiment, the side member connecting formations are configured for engaging with a side forming member at or towards an upper edge of the side forming member.

In one embodiment, the side member connecting formations are configured for engaging with a side forming member at or towards a lower edge of the side forming member.

In one embodiment, the side member connecting formations are configured for engaging with a side forming member at or towards an upper edge of the lower side forming member.

In one embodiment, the side member connecting formations are configured for engaging with a side forming member at or towards a lower edge of the lower side forming member.

In one embodiment, the side member connecting formation defines a recess and/or slot into which at least part of a side forming member is receivable.

In one embodiment, the connector includes an engaging formation configured for engaging with a side forming member proximate the ground.

In one embodiment, the connector includes an engaging formation configured for engaging with a complementary engaging formation on the side forming member.

In one embodiment, the connector is configured for attachment to a plurality of forming pods.

In one embodiment, the connector is configured for providing spacing formations for spacing the plurality of forming pods.

In one embodiment, the connector is configured for supporting a plurality of reinforcing bars extending at right angles to each other.

In one embodiment, the pod connecting formation is configured for connecting to an underside of the pod.

In one embodiment, the pod connecting formation includes a flat plate.

In one embodiment, the pod connecting formation includes piercing formations for piercing the forming pod.

In one embodiment, the connector is configured for supporting the upper side forming member at a height above the lower side forming member.

In one embodiment, the connector is configured for supporting the lower edge of the upper side forming member at a height substantially the same as the upper edge of the lower side forming member.

In one embodiment, the connector is configured for engaging with an upwardly extending flange on a side forming member.

In one embodiment, the pod connecting formation in apertures for receiving fasteners for receiving the connector to the forming pod.

In one embodiment, the connector is integrally formed.

In one embodiment, the connector is made of plastic.

According to a further aspect, the present invention may be said to consist in a side forming member for defining the outer periphery of a foundation slab during pouring of the foundation slab, the side forming member comprising a. a body member configured for defining at least part of an outer side surface of the foundation slab during pouring of the foundation slab;

b. a connecting formation configured for coupling to one or more selected from a forming pod and reinforcing steelwork.

In one embodiment, the connecting formation is configured for connection to a connector as described.

In one embodiment, the side forming member is extruded.

In one embodiment, the side forming member includes at least one zone of engineered weakness to thereby allow removal of a removable portion.

In one embodiment, the side forming member is L-shaped.

In one embodiment, the L-shaped side forming member includes a pair of legs extending at right angles to each other.

In one embodiment, at least one of the legs is configured for extending substantially horizontally in use.

In one embodiment, the side forming member includes an engaging formation for engaging with a connector proximate the ground.

In one embodiment, the side forming member is configured for engaging with a connector towards an upper edge in use.

According to a further aspect, the present invention may be said to consist in a forming pod for facilitating the forming of a foundation, the forming pod comprising:

a. at least one or more connecting formations configured for connecting to one or more selected from
   i. a connector as described, and
   ii. a side forming member as described.

In one embodiment, the connecting formation includes a slot.

In one embodiment, the following pod includes a connector configured for connecting to a side forming member.

According to a further aspect, the present invention may be said to consist in a method of forming a foundation, the method including the steps of:

a. laying one or more selected from
   i. reinforcing steelwork, and
   ii. at least one or more forming pods (the "structure");

b. locating at least one or more side forming members spaced from the structure;

c. connecting the at least one or more side forming members to the structure using a connector to thereby prevent movement of the at least one or more side forming members during pouring of the foundations; and d. pouring settable material into the space between the at least one or more side forming members and the structure.

In one embodiment, the step of locating at least one or more side forming members include the depth of locating a lower side forming member and an upper side forming member in a staggered formation.

In one embodiment, the step of connecting the at least one or more side forming members to the structure using a connector includes the step of engaging a pod connecting formation of the connector with a forming pod.

In one embodiment, the step of connecting the at least one or more side forming members to the structure using a connector includes the step of side connecting formation of the connector with a side forming member.

In one embodiment, the step of connecting the at least one or more side forming members to the structure using a connector includes the step of engaging a lower connecting formation of the connector with a lower side forming member.

In one embodiment, the step of connecting the at least one or more side forming members to the structure using a connector includes the step of engaging an upper connecting formation of the connector with an upper side forming member.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Other aspects of the invention are also disclosed.

BRIEF DESCRIPTION OF THE DRAWINGS

Notwithstanding any other forms which may fall within the scope of the present invention, a preferred embodiments of the invention will now be described, by way of example only, with reference to the accompanying drawings in which.

DETAILED DESCRIPTION

Figure 1:
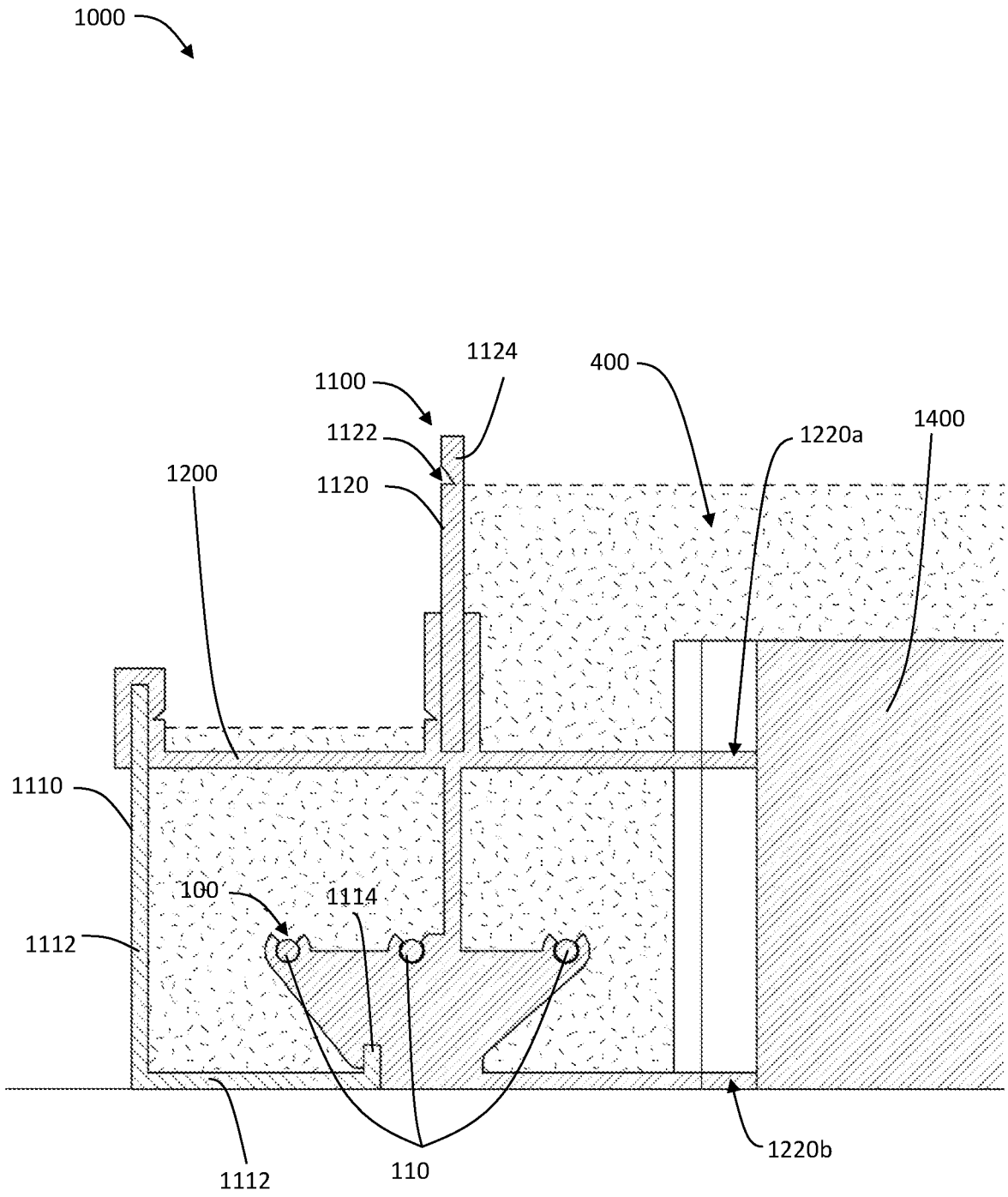
FIG. 1 shows a cross-section view of a first embodiment of a foundation forming arrangement and connector in use in a foundation.

It should be noted in the following description that like or the same reference numerals in different embodiments denote the same or similar features. Different embodiments designated with a different multiple of the one thousand numerals.

A foundation forming arrangement according to a first aspect of the invention is generally indicated by a multiple of the numeral 1000. Reinforcing steelwork such as reinforcing bars and the like is generally indicated by the numeral 100 and a foundation slab by the reference numeral 400.

It should be understood that the foundation forming arrangements described below are generally regarded as being sacrificial in that they will mostly not be recovered from the foundation slab once poured.

The foundation forming arrangements shown in the figures typically includes at least one or more side forming members generally configured for forming the side of a foundation slab 400 in use, and a connector generally configured for connecting the at least one or more side forming members to either one or more forming pods, or to the reinforcing steelwork 100 of the foundation slab, to thereby hold the side forming member or members in place against the pressure of the concrete when it is poured to form the foundation slab. In some of the embodiments it will be appreciated that a forming pod forms part of the foundation forming arrangement, and in other embodiments, no forming pods are required, or are incidental.

In one embodiment now described with reference to FIGS. 1 and 2, there is provided a foundation forming arrangement 1000 for forming the side of a foundation slab 400. The foundation forming arrangement 1000 includes two types of side forming members 1100 in the form of a lower side forming member 1110 and an upper side forming member 1120. The foundation forming arrangement 1000 further includes a plurality of connectors 1200 that are preferably spaced regularly along the length of the side forming members 1100, and forming pods 1400. The connectors 1200 are configured for coupling the side forming members 1100 to reinforcing bars 110 in the reinforcing steelwork 100 of the foundation slab, as well as to forming pods 1400.

The lower side forming member 1110 is preferably L-shaped in cross-section, defining two legs 1112, and is preferably composed of an extruded plastic. The lower side forming member 1110 is intended to be laid on the ground, preferably on top of a plastic protective sheet 300, with one of the legs 1112 of the L-shape extending substantially vertically and the other of the legs extending substantially horizontally along the ground and inwardly towards the reinforcing steelwork 100. The lower side forming member 1110 includes an engaging formation in the form of a lip 1114 or flange that extends upwardly along the distal edge of the horizontally extending leg of the lower side forming member 1110. The lip 1114 is configured for engagement with a complementarily shaped engaging formation in the form of an inverted channel 1210 on the connector 1200.

The upper side forming member 1120 is preferably configured as a planar board. The upper side forming member 1120 also includes a zone of engineered weakness 1122 extending along the length that allows an upper removable portion 1124 of the upper side forming member 1120 to be removed, preferably at the top level of the foundation slab 400 in use once it is poured. In an alternative embodiment (not shown), it is envisaged that the upper side forming member could also be L-shaped in cross-section, or any other shape.

Preferably both the upper side forming member 1120 and the lower forming member 1110 are composed of plastic that has been created in an extrusion process.

The connector 1200 includes upper and lower pod connecting formations 1220 *a&b*. The pod connecting formations 1220 are sliding engaging formations that are slidingly engageable with a complementary engaging formation 1410 on the forming pod 1400. The pod connecting formations 1220 are provided in the form of an upper head and neck formation 1222 and a lower head and neck formation 1224. The pod connecting formations 1220 are configured for engaging with the connecting formation 1410 in the form of a complementary slot 1412 on the forming pods 1400.

Figure 3:
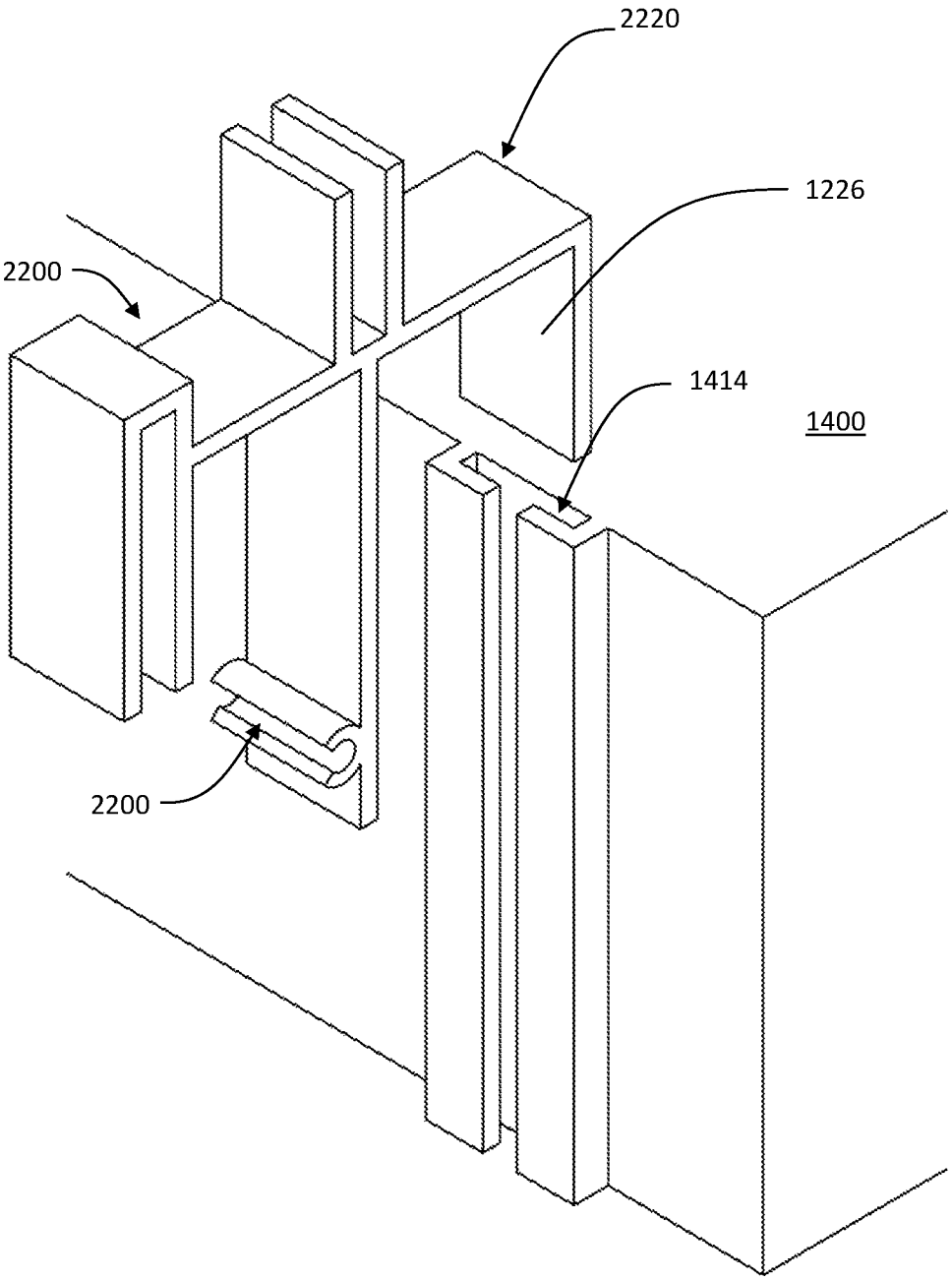
FIG. 3 shows a top right front perspective view of a second embodiment of a connector and forming pod.

Preferably a plurality of pod connecting formations 1220 are connected to the forming pods 200 towards both an upper and lower part of the forming pod in order to provide stability, however in an alternative embodiment (for examples as shown in FIG. 3), a single connection may be provided, that could be engaged with a forming pod at any height.

The connector 1200 further includes side member connecting formations 1230, including an upper side member connecting formation 1232 defining a slot and a lower side member connecting formation 1234 defining another slot. The slot of the upper side member connecting formation 1232 opens upwardly. The slot of the upper side member connecting formation 1232 is configured for receiving and supporting the upper side forming member 1120 in position. The slot of lower side member connecting formation 1234 opens downwardly and is configured for receiving and supporting in position the upper edge of the vertically extending leg 1112 of the lower side forming member 1110.

The lower side member connecting formation includes a frangible zone of engineered weakness 1235 that allows the outer portion 1237 to be removed, preferably at the level at which the foundation slab is poured.

The upper side member connecting formation also includes a frangible zone of engineered weakness 1233 that allows the outer portion 1239 to be removed, also preferably at the level at which the foundation slab is poured.

The slots 1232 and 1234 are preferably configured for holding the upper side forming member 1120 and a portion of the lower side forming member 1110 parallel to each other. However, in alternative embodiments (not shown) the side forming members may be held at any alignment relative to each other.

The connector 1200 further includes a support formation in the form of a leg 1240 that is configured for preferably directly supporting the weight of the upper side forming member 1120 off the ground. The leg 1240 is preferably configured for abutment with the ground and/or the horizontally extending leg of the lower side forming member 1110, and extends directly underneath the upper side forming member 1120.

Preferably, the connector 1200 is composed of a mouldable material such as plastic, and is integrally formed in a moulding process, such as an injection moulding process.

The connector 1200 further includes reinforcing bar connecting formations 1250 for connecting to reinforcing bars 110 of reinforcing steelwork. Preferably, the reinforcing bar connecting formations 1250 are snap-fit type connecting formations, whereby the individual reinforcing bars can be pushed downwardly to fit snugly into a receiving recess. Preferably, the connector 1200 is configured to also support the reinforcing steelwork 100 at a prescribed distance from the ground. In this way, the height that the reinforcing steelwork 100 is supported off the ground, as well as the distance that the steelwork is held from the side forming members 1100 and/or the forming pods 200 can be designed to meet required building standards.

In another embodiment as shown in FIG. 3, connector 2200 includes only a single reinforcing bar connecting formation 2250 for clipping onto one of the bars 110 of the reinforcing steelwork 100. In addition, the pod connecting formation 2220 is provided in the form of a single sliding formation 2226 that is inserted downwardly into a slot 1414 on the forming pod 1400. In this embodiment, no lateral support is provided for a lower side forming member at its base.

Figure 4:
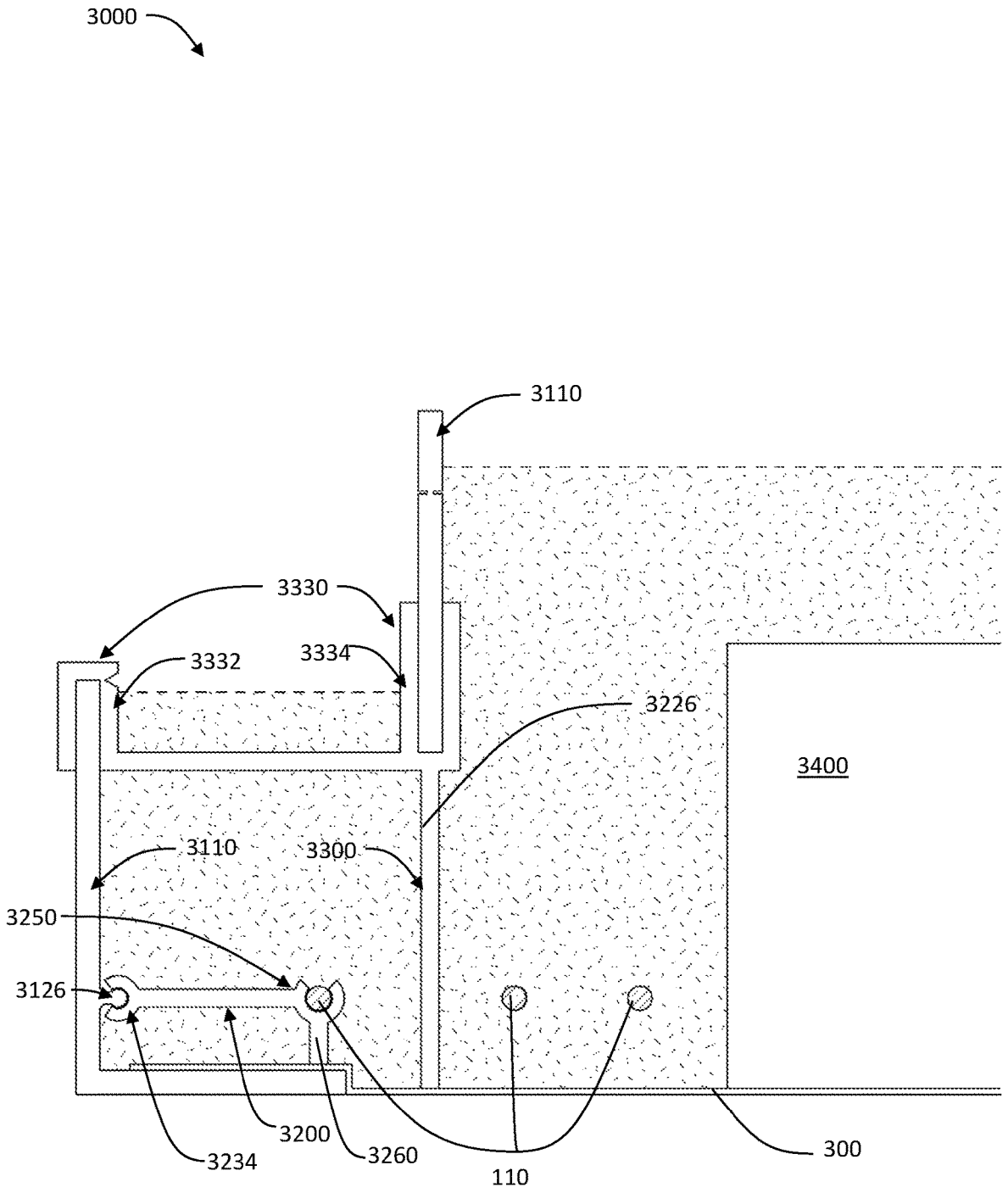
FIG. 4 shows a cross-section view of a third embodiment of a foundation forming arrangement, connector and support arrangement in use in a foundation.

In a further embodiment shown in FIG. 4, a foundation forming arrangement 4000 is provided including independent support formation 3300 that is independent of connector 3200. The independent support formation 3300 includes side member connecting formations 3330, including a lower side member connecting formation 3332 defining a slot and an upper side member connecting formation 3334 defining another slot. Lower side forming member 3110 is slidingly receivable into the slot of lower side member connecting formation 3332, and upper side forming member 3120 is receivable into the slot of upper side member connecting formation 3334. The independent support formation 3300 further includes support leg 3240 on which the weight of upper side forming member 3120 is supportable.

In addition to the independent support formation 3300, the foundation forming arrangement 3000 includes a separate connector 3200. The separate connector 3200 includes side member connecting formation 3234 that is configured for engaging with and connecting to a complementary connector formation 3126 on the lower side forming member 3110. The complementary connector formation 3126 preferably extends along the length of the lower side forming member 3110 (the lower side member preferably being an extrusion).

The separate connector 3200 further includes reinforcing bar connecting formation 3250, that is configured for engaging with and connecting to one of the reinforcing bars 110 of the reinforcing steelwork 100. In addition, the separate connector 3200 further includes a support leg 3260 for supporting the reinforcing bar a 110 at a predetermined distance off the ground. In an alternative embodiment (not shown), it is envisaged that the separate connector 3200 can support a plurality of the reinforcing bars 110. In addition, it is envisaged that in an alternative embodiment (not shown) the separate connector can include connecting formations for connecting to the forming pod in the same way as the connector of FIGS. 1-3 can.

Figure 2:
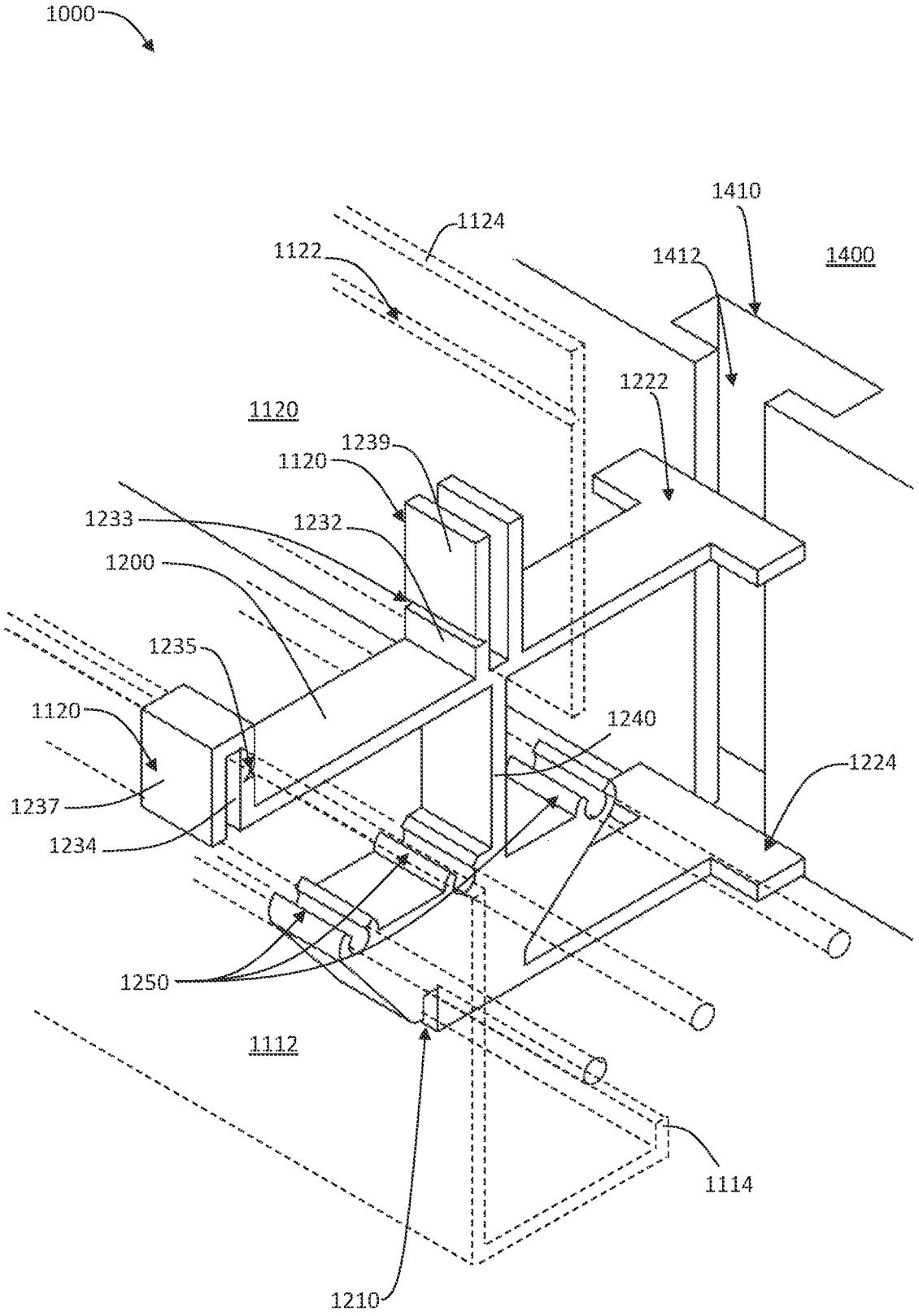
FIG. 2 shows a top right front perspective view of the foundation forming arrangement of FIG. 1, showing a hidden view of a first embodiment of the connector.

In the embodiment shown in FIG. 4, the lower side member connecting formation 3332 and upper side member connecting formation 3334 are configured for receiving the lower side forming members and upper side forming members, respectively, in a sliding engagement similarly to the embodiment shown in FIGS. 1 and 2.

Figure 5:
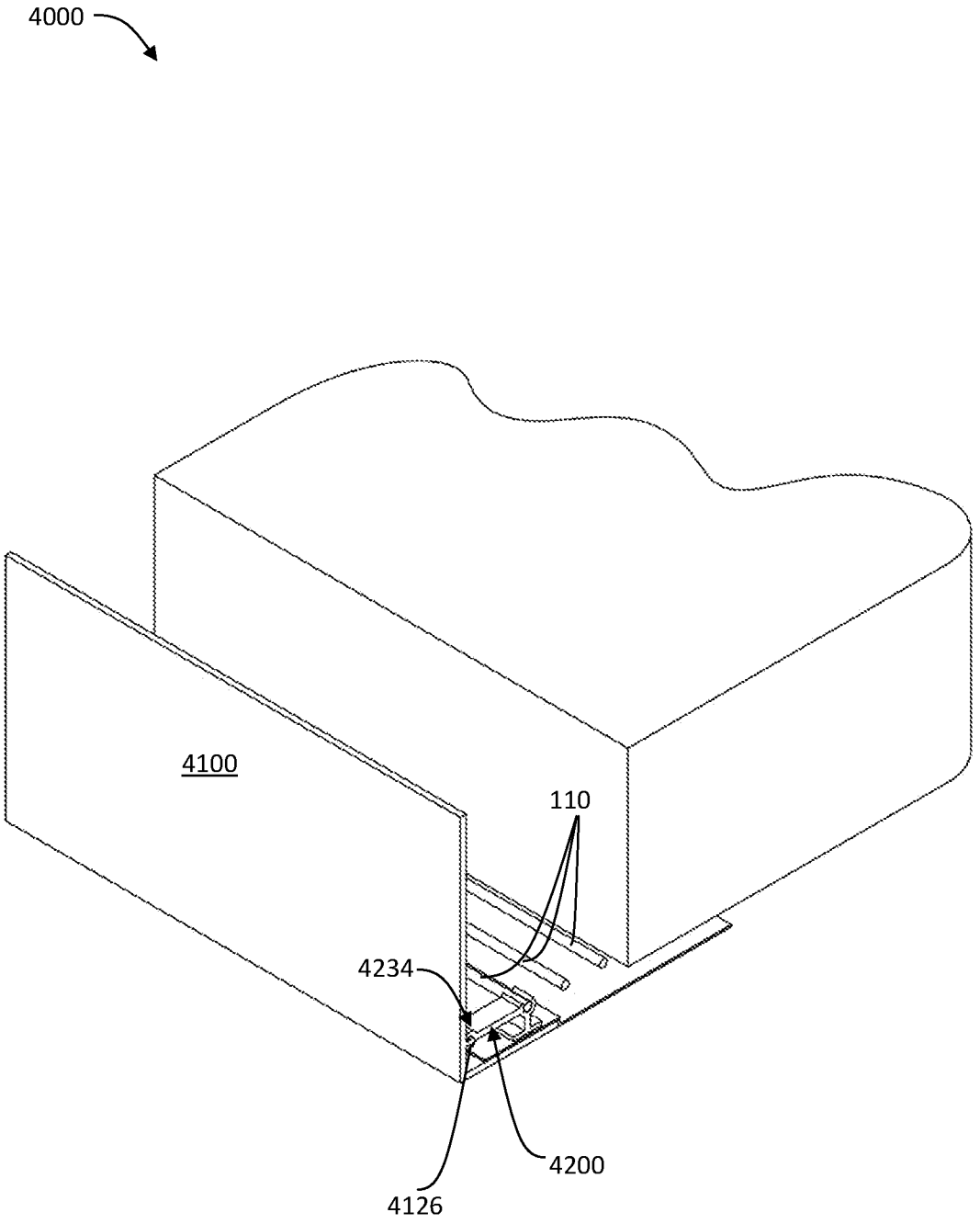
FIG. 5 shows a top right front perspective view of a fourth embodiment of a foundation forming arrangement, connector and support arrangement, shown in position with reinforcing bars and a forming pod.

In a further embodiment shown in FIG. 5, a foundation forming arrangement 4000 is shown in which a pair of side forming members is required. In this embodiment, a single L-shaped side forming member 4100 is provided. The L-shaped side forming member 4100 is connected to at least one or more of the reinforcing bars 110 by a separate connector 4200 similar to the separate connector 3200 shown in FIG. 4. To this end, the side forming member 4100 includes a complementary connector formation 4126 on the inside wall of the side forming member 4100 that is engageable with a side member connecting formation 4234 on the separate connector 4200.

Figure 6:
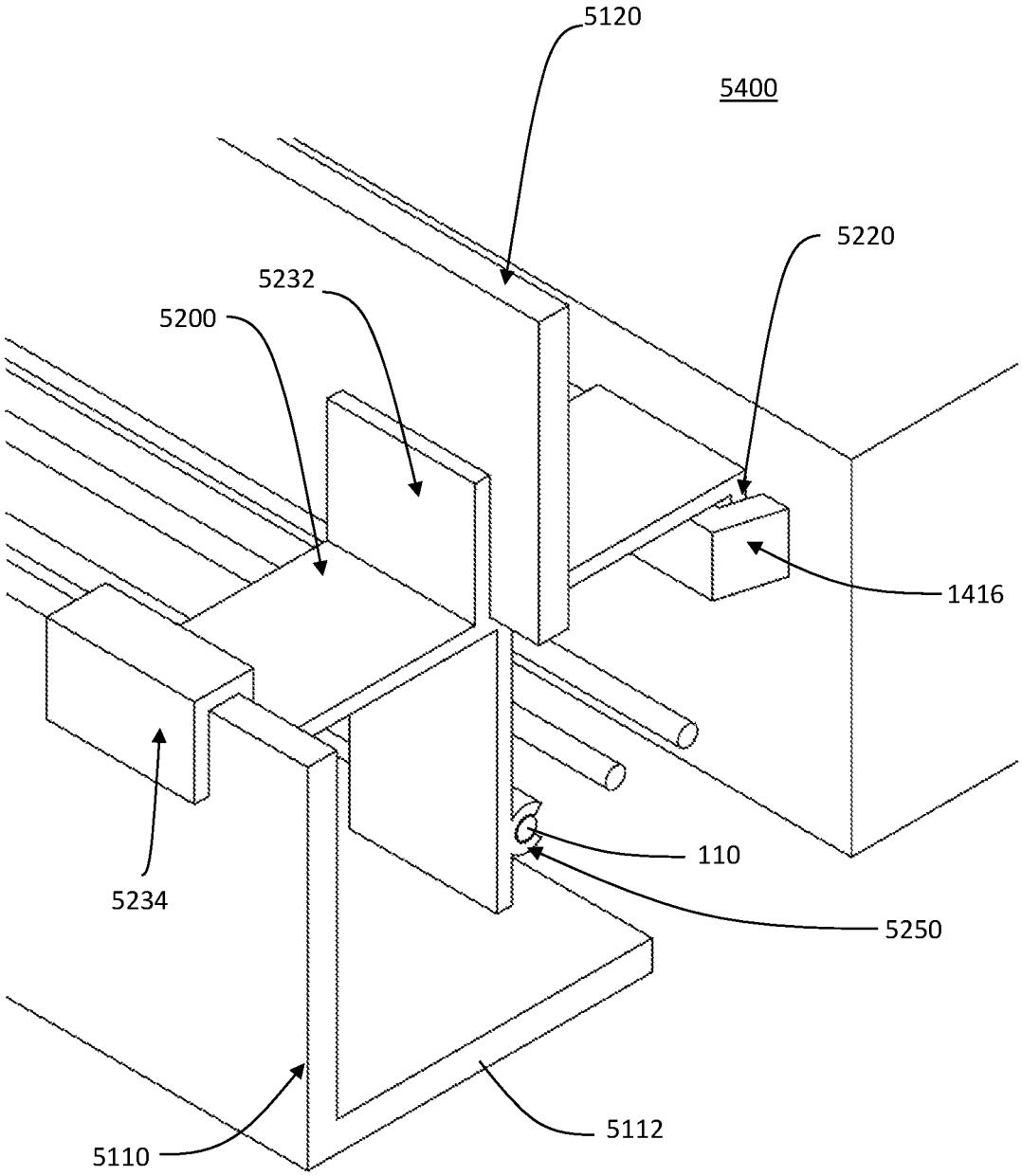
FIG. 6 shows a top right front perspective view of a fifth embodiment of a foundation forming arrangement, shown in position with reinforcing bar and a forming pod.

In yet another embodiment shown in FIG. 6, a foundation forming arrangement 5000 is provided in which the connector 5200 stands on a horizontally extending leg 5112 of the lower side forming member 5110. The connector 5200 includes reinforcing bar connecting formation 5250, pod connecting formation 5220, lower side member connecting formations 5234, and upper side member connecting formations 5232, for connection to reinforcing bar 110, complementary engaging formation 1416 of forming pod 5400, lower side forming member 5110 and an upper side forming member 5120, respectively, to thereby hold these together in a predetermined configuration during pouring of the foundation slab.

Figure 7:
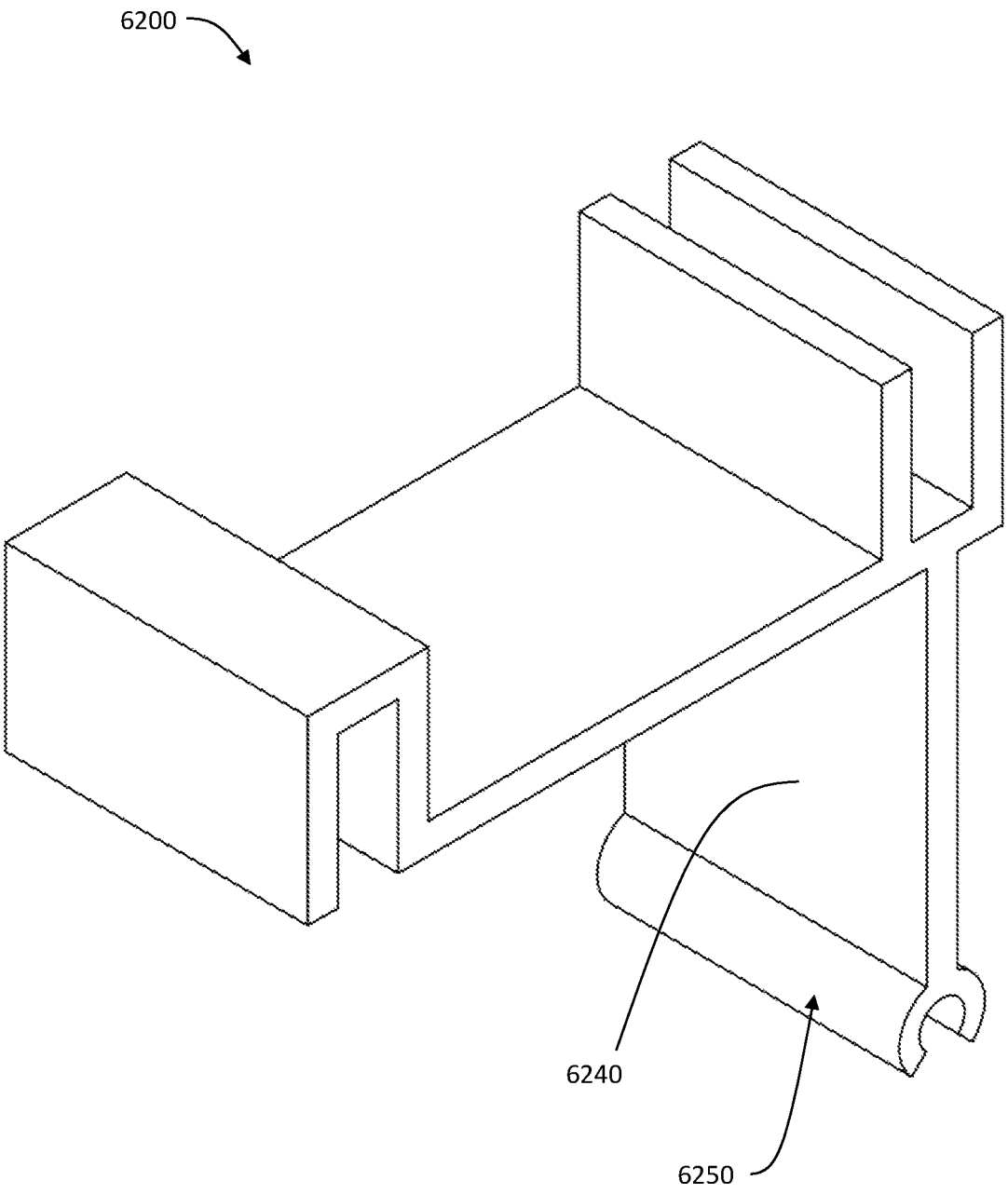
FIG. 7 shows a top right front perspective view of a sixth embodiment of a connector.

In yet another embodiment of a connector 6200 shown in FIG. 7, the connector 6200 is configured for itself being supported on a reinforcing bar, and in turn supporting the weight of the upper side forming member (not shown) on support leg 6240. The connector is preferably engaged with reinforcing bar 110 by reinforcing bar connecting formation 6250.

Figure 8:
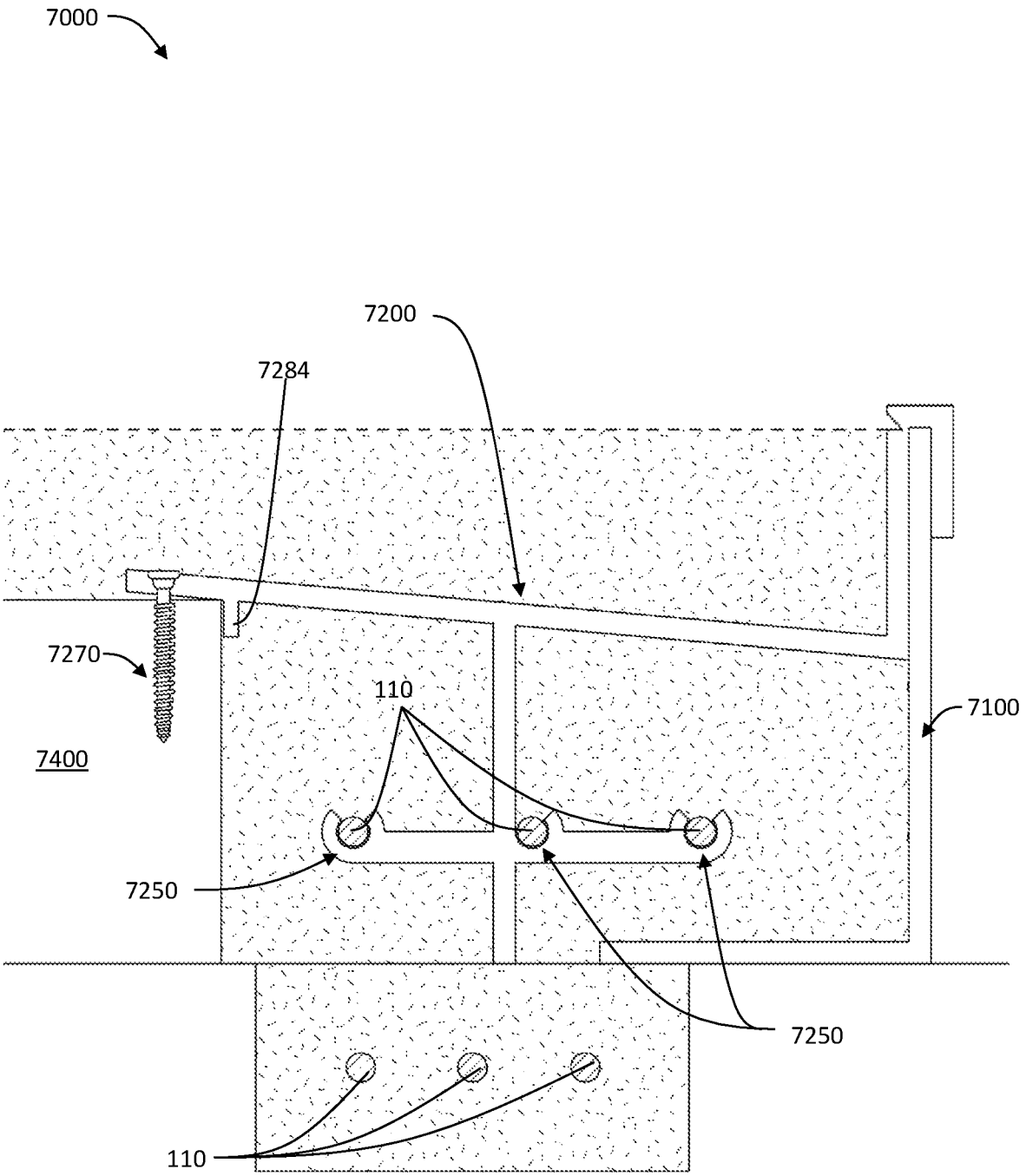
FIG. 8 shows a cross-section view of a seventh embodiment of a foundation forming arrangement and connector, shown in use in a foundation.

A further embodiment of a foundation forming arrangement 7000 is shown in FIG. 8. In this embodiment, the connector 7200 is configured for supporting three reinforcing bars 110 on reinforcing bar connecting formations 7250. The connector 7200 extends over the top of forming pod 7400, wherein it is fastened to forming pod 7400 by a fastener 7270. Connector 7200 further includes a bracing flange 7284 bracing the connector against a side of the forming pod 7400.

It will be appreciated that the foundation slab of this embodiment is fundamentally different from the foundation slab of, for example, FIGS. 1 and 4. For the foundation slab as shown in FIGS. 1 and 4, the finished foundation slab is located above the ground, forming a rigid raft on which a construction may be built. Such a raft-type foundation slab is useful in areas where ground movement is encountered, or in areas where unsupportive soil is found. For the foundation slab shown in FIG. 8, a sunken foundation slab is initially poured into trenches dug into the ground, and a subsequent upper slab is poured above the sunken foundation slab, with the sunken foundation slab providing support for the upper slab. The sunken foundation slab may not necessarily be integrally formed with the subsequently poured foundation slab, although it can be.

Figure 9:
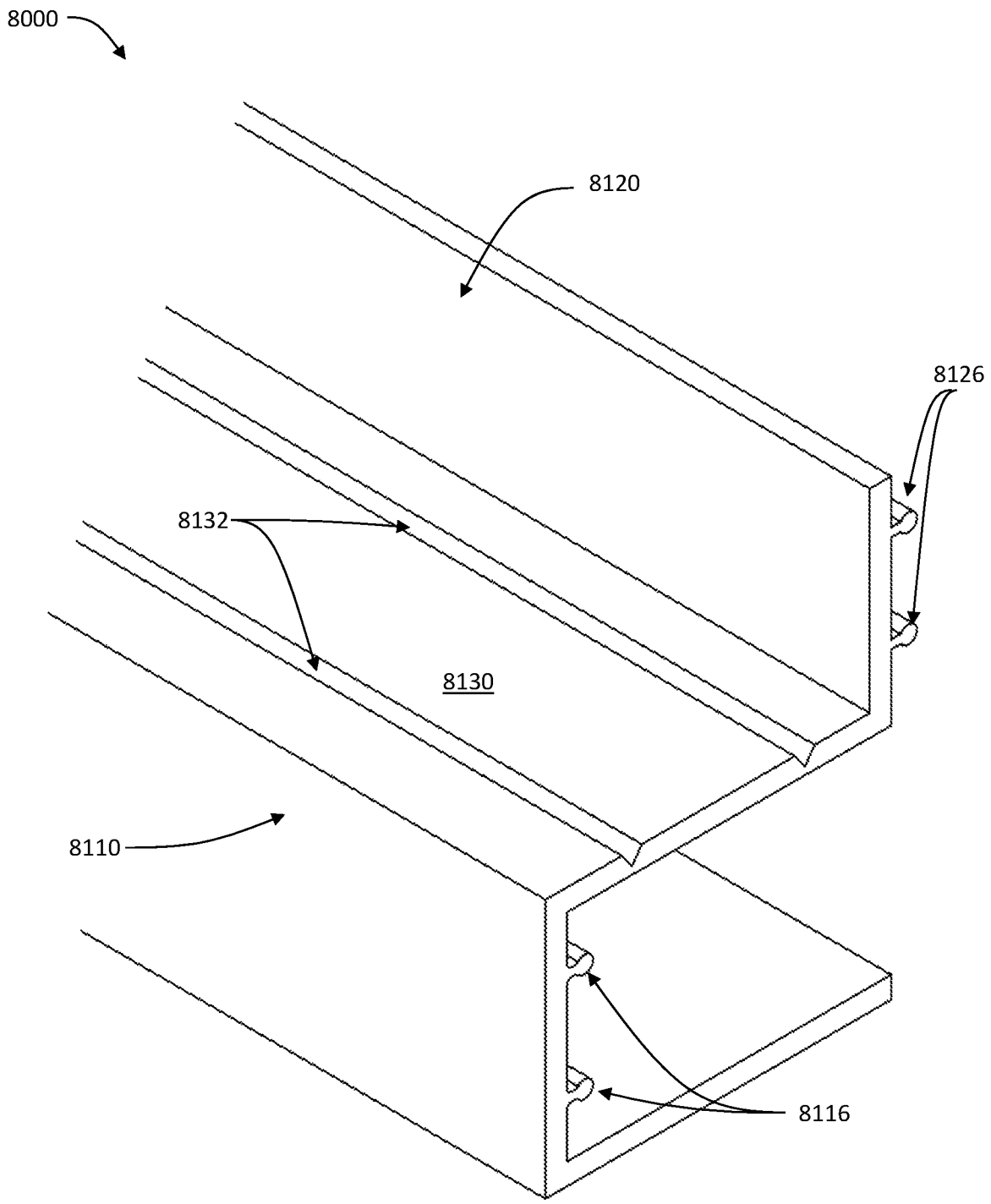
FIG. 9 shows a top right front perspective view of a second embodiment of a side forming member.

In the embodiment shown in FIG. 9, the foundation forming arrangement 8000 includes an upper side forming member 8120 and lower side forming member 8110 that are connected to each other by a removable portion 8130. It is envisaged that using this embodiment, no support need be provided for the upper side forming member 8120 by a support formation. Frangible zones of engineered weakness 8132 are provided at each side of the removable portion 8130, allowing the removable portion to be removed after pouring of the foundation slab. It should also be noted that in this embodiment both the upper side forming member 8120 and the lower side forming member 8110 are provided with connecting formations 8116, 8126 for connecting to a connector (not shown).

Figure 10:
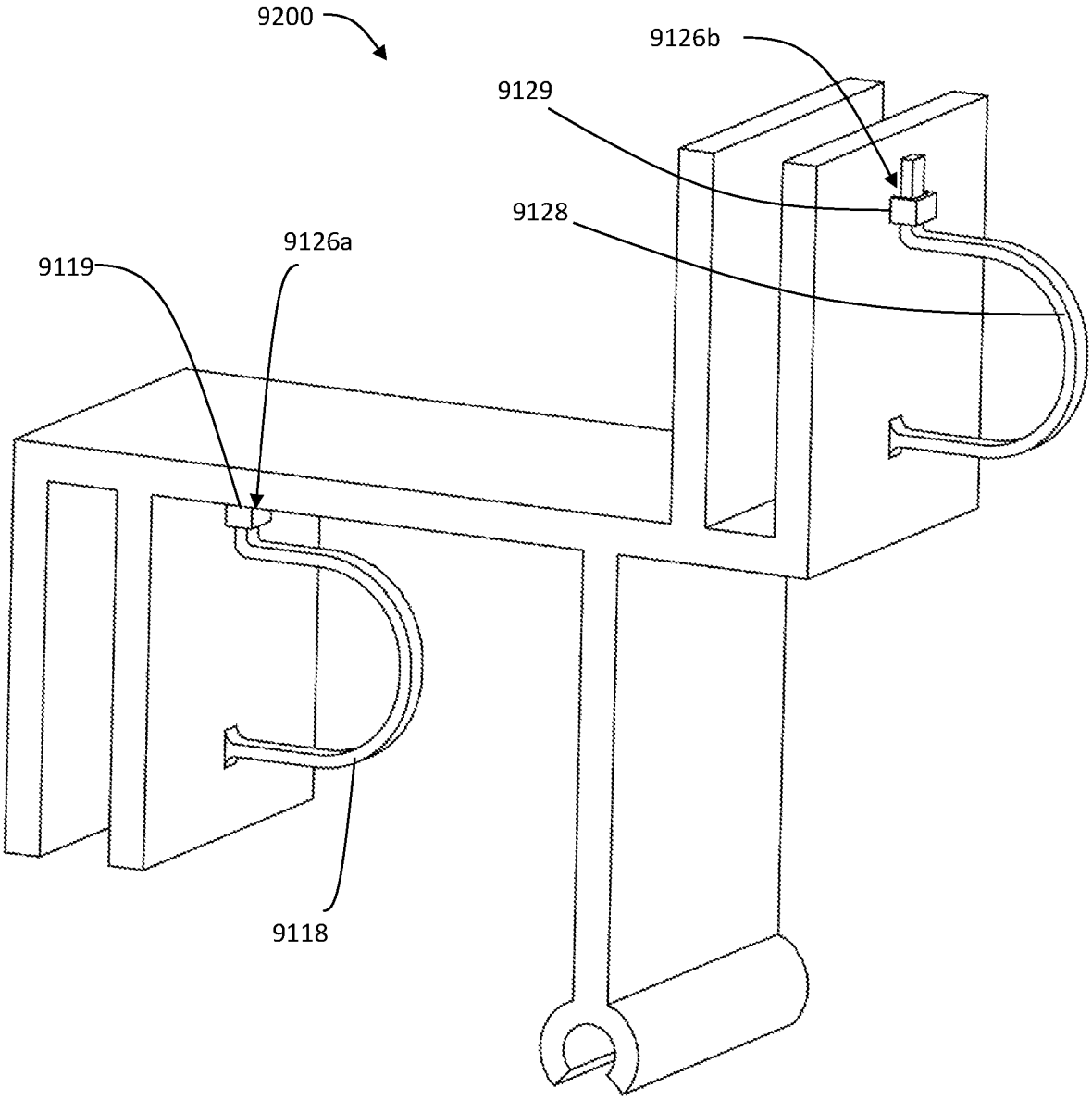
FIG. 10 shows a top right rear perspective view of an eight embodiment of a connector.

In another embodiment of a connector 9200 shown in FIG. 10, the connector 9200 is similar to the connector shown in FIG. 7. However, connector 9200 is provided with an upper connecting formation **9126*b* in the form of a tether 9128 for connecting to steel work or a forming pod, as well as a lower connecting formation 9126*a* in the form of a tether 9118 for connecting to steel work or a forming pod. Tethers 9128, 9118 preferably include tooth formations (not shown) along at least part of their length, and are receivable through apertures in tether receiving formations 9119, 9129. Tether receiving formations 9119, 9129** preferably include ratchet-type mechanisms (not shown) for engaging with and preventing withdrawal of the tooth formations along the length of the tethers, similar to those commonly found in zip tie arrangements. In a preferred embodiment, it is envisaged that the tethers and tether receiving formations will be integrally formed with the connector. However, the tethers and tether receiving formations may be separately formed and attachable to the connector.

It will be appreciated by a person skilled in the art that a wide variety shapes and configurations of connecting formations could be provided for connecting a connector to a forming pod and/or reinforcing steelwork. Such connecting formations could also work using a wide variety of principles, including positive locking, friction, tension, or the like.

Figure 11:
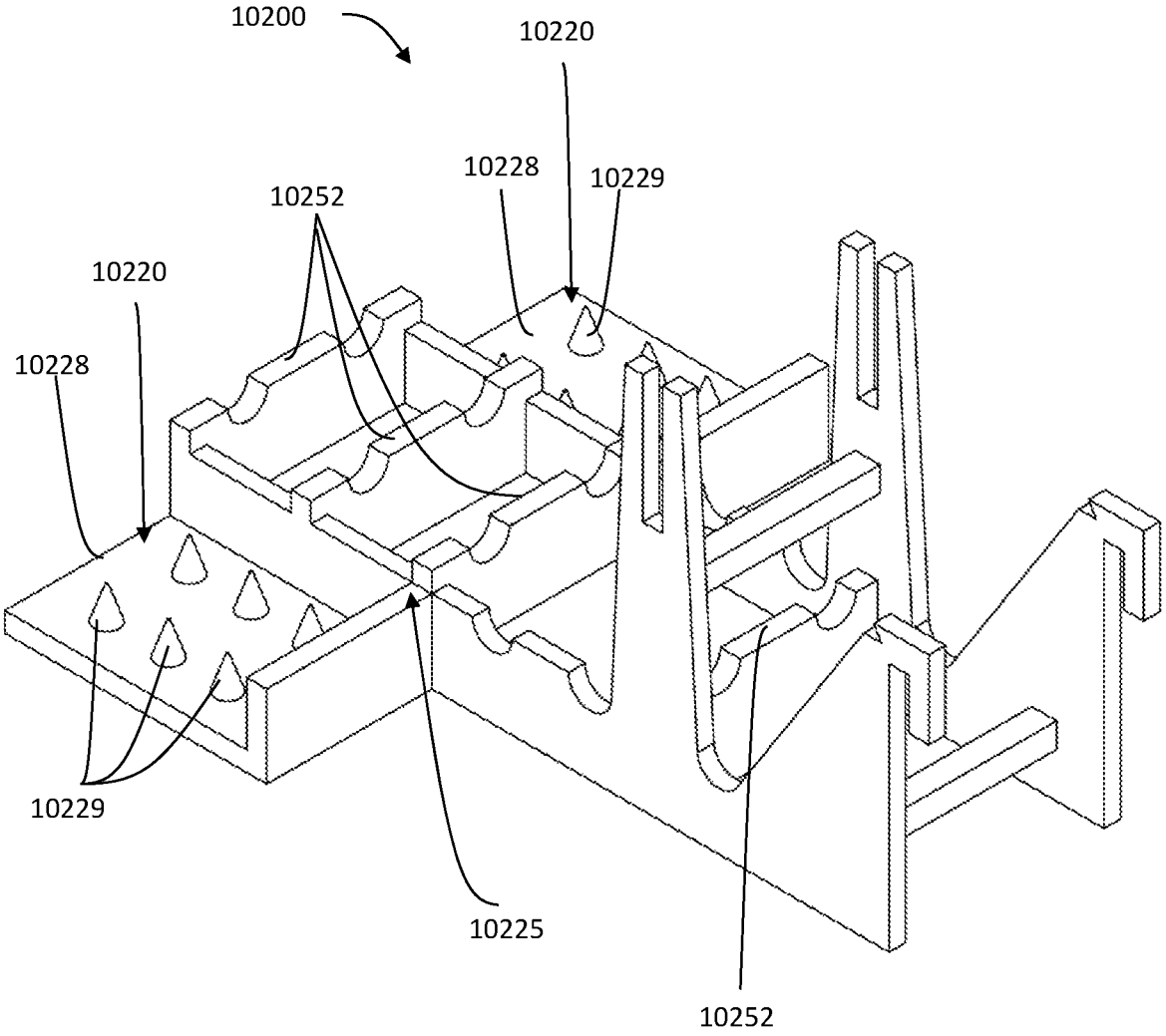
FIG. 11 shows a top left front perspective view of a ninth embodiment of a connector.
Figure 12:
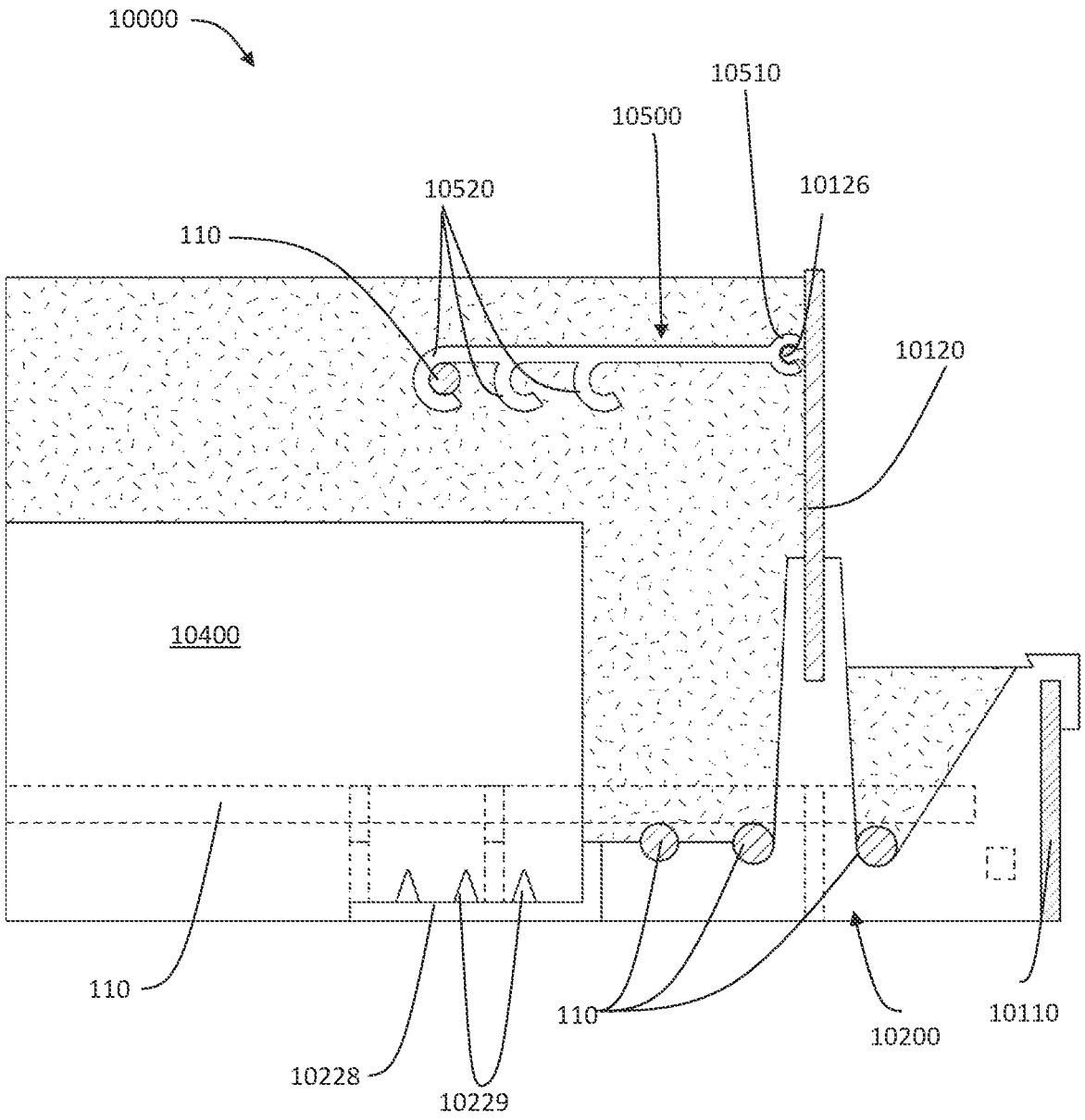
FIG. 12 shows a cross-section view showing the connector of FIG. 11 in use in a foundation forming arrangement.

A further embodiment of a foundation forming arrangement 10000 and associated connector 10200 is shown in FIGS. 11 and 12. Connector 10200 includes pod connecting formations 10220 in the form of horizontal flat plates 10228 with sharp spikes 10229 extending from the flat plates. The pod connecting formations 10220 are configured for extending underneath the corners of forming pods 10400 and further include corner flanges 10225 for locating the corner of the forming pods 10400.

In use, relatively soft, preferably polystyrene, forming pods 10400 will be located over the flat plates 10228 until corner flanges 10225 are in abutment a corner of the forming pods 10400. The forming pod 10400 will then be pressed downwardly until spikes 10229 are inserted into the bottom of the forming pod 10400, thereby preventing relative movement between the connector 10,200 and the forming pod 10400. In this way, the forming pods can be accurately spaced from each other. It will be appreciated by a person skilled in the art that a wide variety of alternative pod connecting formations may be provided, including snap-fit type connecting formations, bayonet type connecting formations, bonding or any other suitable connecting formations, including holes for fasteners such as screws.

Further, the connector 10200 acts to support reinforcing bars extending downwardly in the channel between forming pods 10,400. To this end, the connector 10200 includes reinforcing bar support formations 10252 that are configured for supporting the reinforcing bars 110 extending between forming pods 10400 at a slightly increased height than the reinforcing bars 110 extending along the side of the foundation parallel to the side forming members 10100. This will allow the crossing bars to be attached to each other using standard practice such as twisted wire connectors or the like. In an alternative embodiment, it is envisaged that reinforcing bar support formations 10252 may support the reinforcing bars 110 extending between adjacent forming pods 10400 at a lower height than the reinforcing bars 110 extending parallel to the side forming members 10100.

Further, as shown in FIG. 12, it is envisaged that the upper side forming member 10120 can include connector formations 10126 similar to those shown in FIG. 9. The connector formations 10126 can be used for connecting the upper side forming member 10120 to reinforcing bars 110 extending over the top of forming pods 10400 using a secondary connector formation 10500. The secondary connector formation 10500 is configured for engaging securely with connector formations 10026 via a snapfit formation 10510, and to reinforcing bar 110 via a hook formation 10520. A plurality of hook formations 10520 provided to account for varying distances to reinforcing bars 110.

It will be appreciated that a wide variety of different configuration connectors may be possible at each end of the connector formation 10500. Using the embodiment shown in FIGS. 11 and 12, it is envisaged that the forming pods 10400, the reinforcing bars 110 and the side forming members 10100 can be set out with accurate spacing, and in order to ensure that best practice in the construction of the foundation slab is followed.

In another embodiment now shown with reference to FIGS. 13-22, there is provided another embodiment of a foundation forming arrangement 11000. The foundation forming arrangement 11000 consists of a number of interengaging components that are configured to engage with each other using a variety of engaging formation such as snap type connections, sliding pipe connections, and the like. These will be explained in more detail below.

The foundation forming arrangement 11000 includes an upper connector 11201 (shown in FIGS. 13, 19, 21, 22, 23 and 25) and a lower connector 11202 (shown in FIGS. 13, 14, 21, 22, 23 and 25) that are configured to connect to each other, preferably by means of a snapfit—type connecting arrangement . The upper connector 11201 is configured for engaging with and holding in position an upper side forming member 11120, as well as the top of a lower side forming member 11110.

The upper side forming member 11120 includes a panel 11128 and a pair of right angled protrusions 11,126 extending along the length of the upper side forming member.

The upper connector 11201 connects to the upper side forming member 11120 to hold it up right by means of engaging formations 11232 defining a right-angled tab that are receivable into a slot defined by right angled protrusions 11126 extending along the length of the upper side forming member 11120. Upper connector 11201 further includes a supporting formation 11235 in the form of a slot into which the lower edge of the upper side forming member is receivable.

Lower side forming member 11110 includes a pair of planar panels 11117 extending extending as right angled legs to each other, with one leg being configured for extending horizontally along the ground in use, and the other leg being configured for extending substantially vertically in use. The upper connector 11201 connects to the lower side forming member 11110 by means of similar engaging formations 11234 defining a right-angled tab which is receivable into complementary connecting formations in the form of right-angled protrusions 11116 defining upwardly facing slots extending along the length of lower side forming member 11110.

The lower connector 11202 also includes an engaging formation 11210 defining a right-angled tab for being received into a slot 11118 on the lower side forming member 11110.

Upper connector 11201 and lower connector 11,202 are also engageable with each other by a dovetail sliding connector arrangement including a head and neck formation 11222 and the complementary receiving slot 11224.

Figure 13:
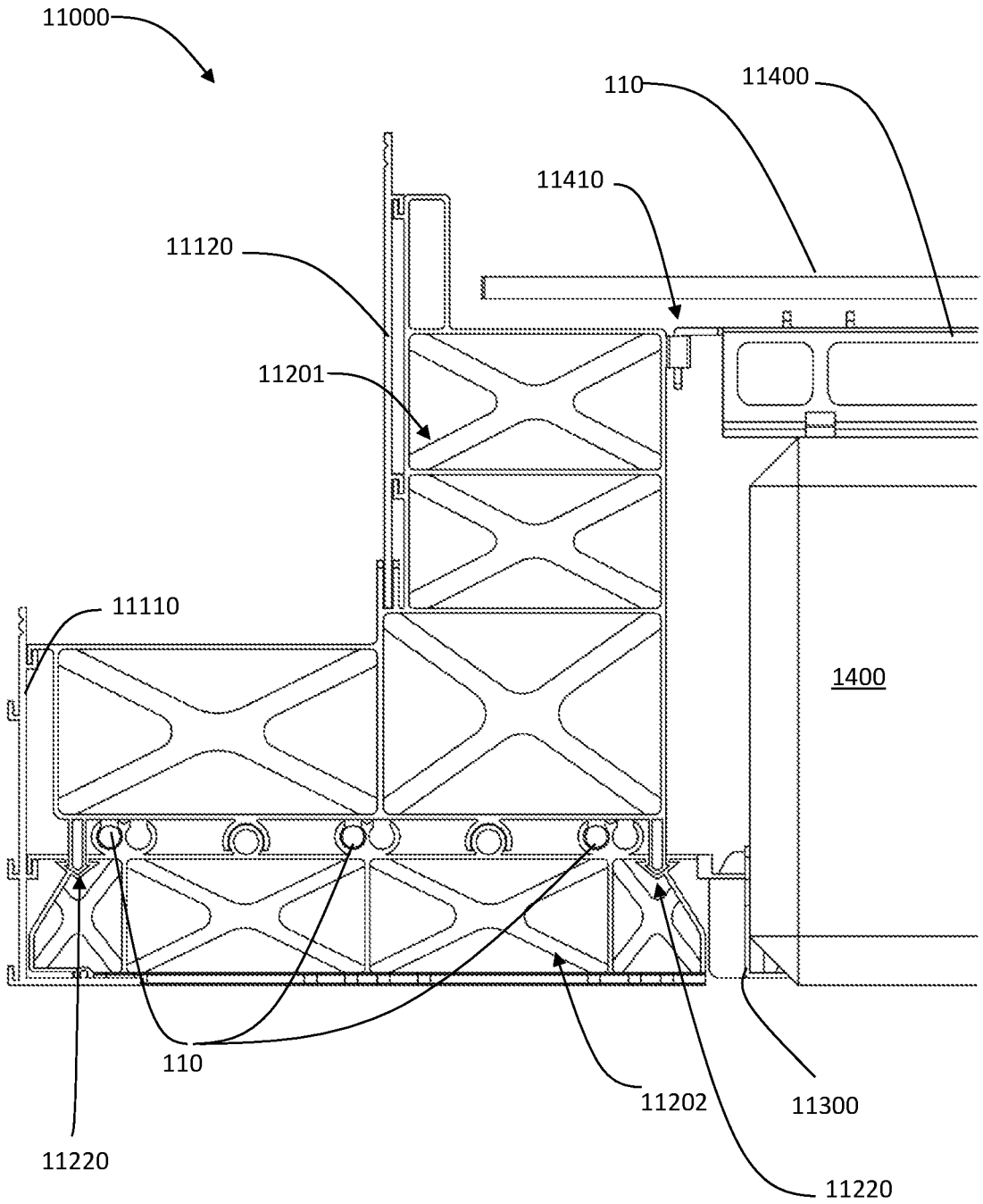
FIG. 13 shows a side elevation view of an eighth embodiment of a foundation forming arrangement.
Figure 14:
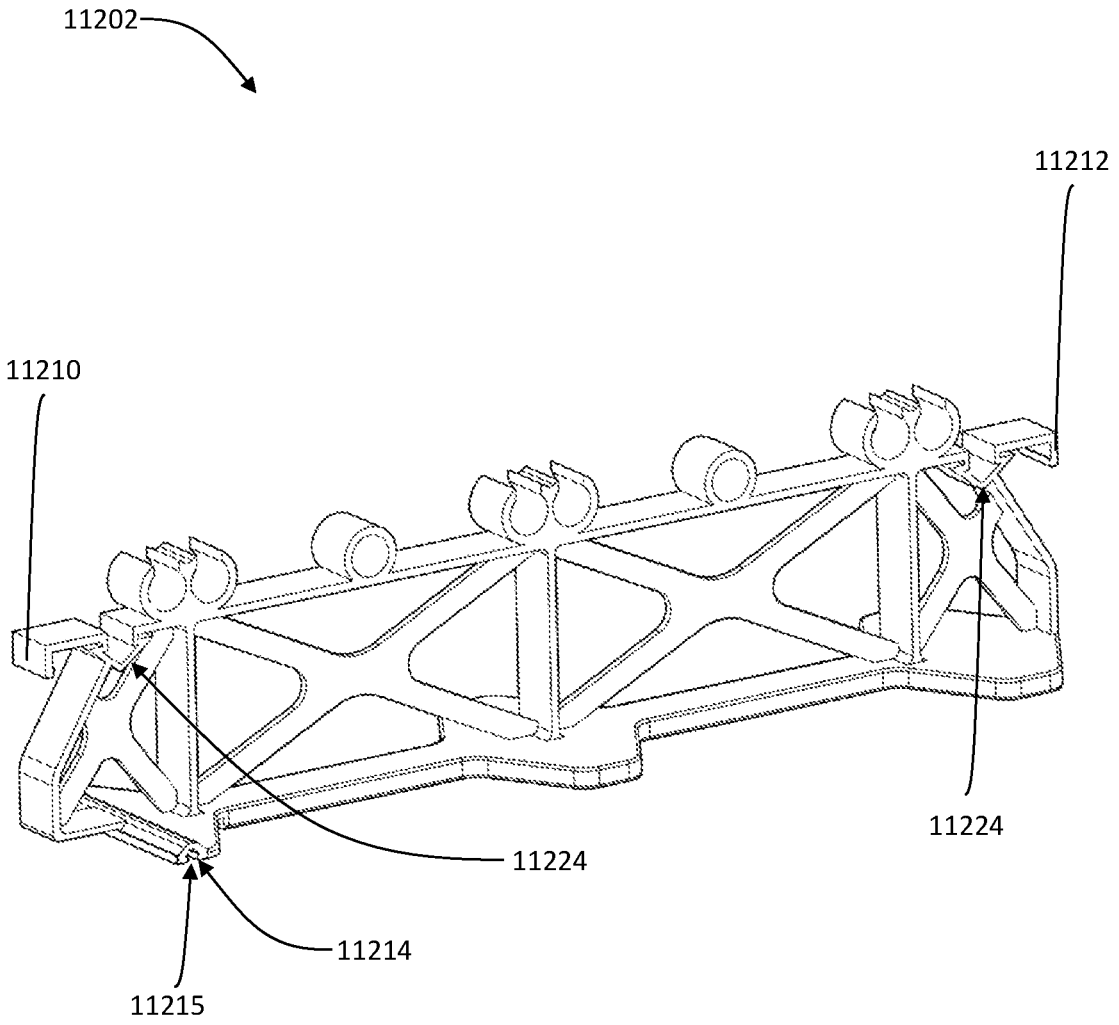
FIG. 14 shows a side front perspective view of a lower connector of FIG. 13.
Figure 15:
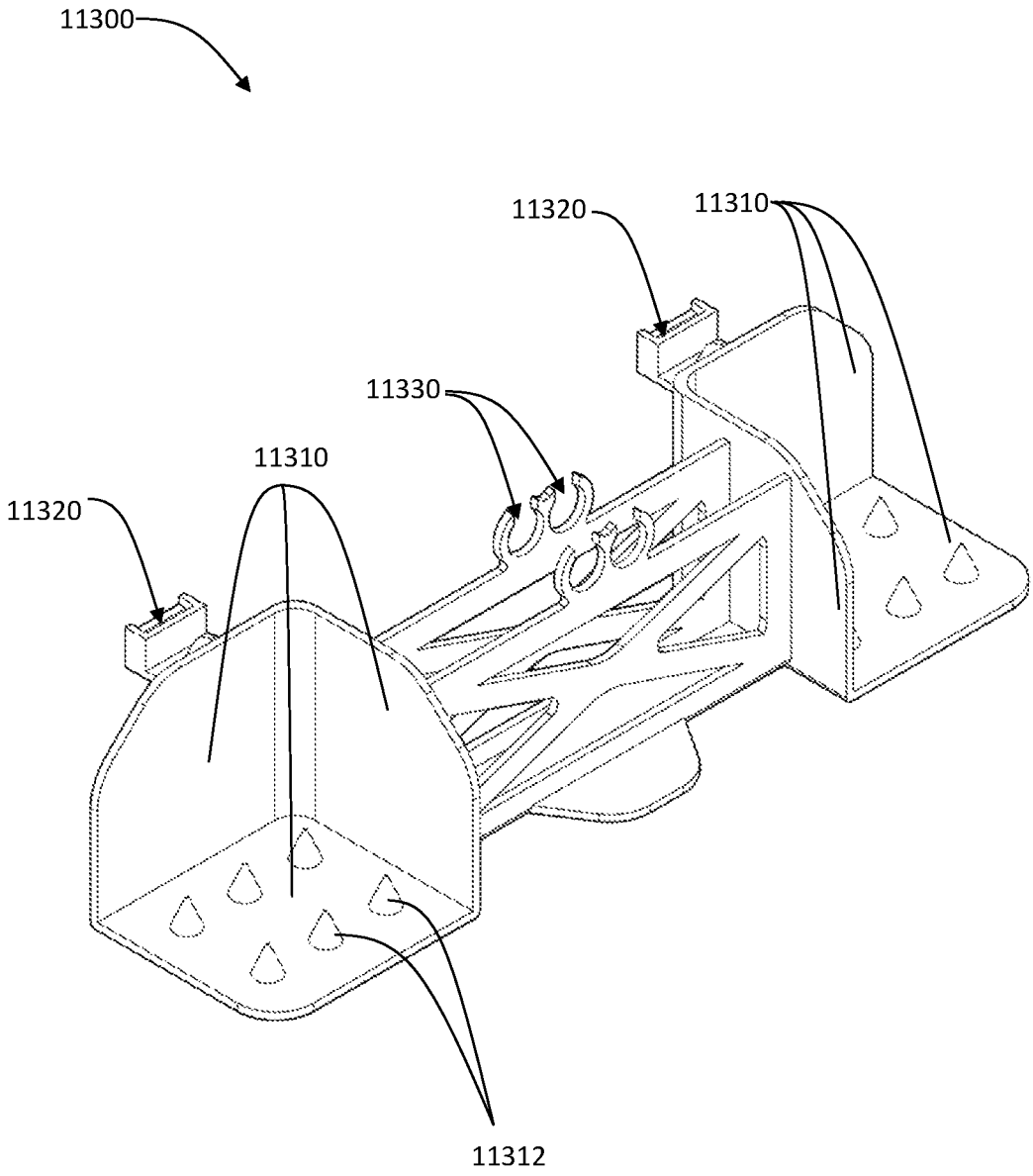
FIG. 15 shows a side rear perspective view of a pod base securing arrangement of FIG. 13.
Figure 16:
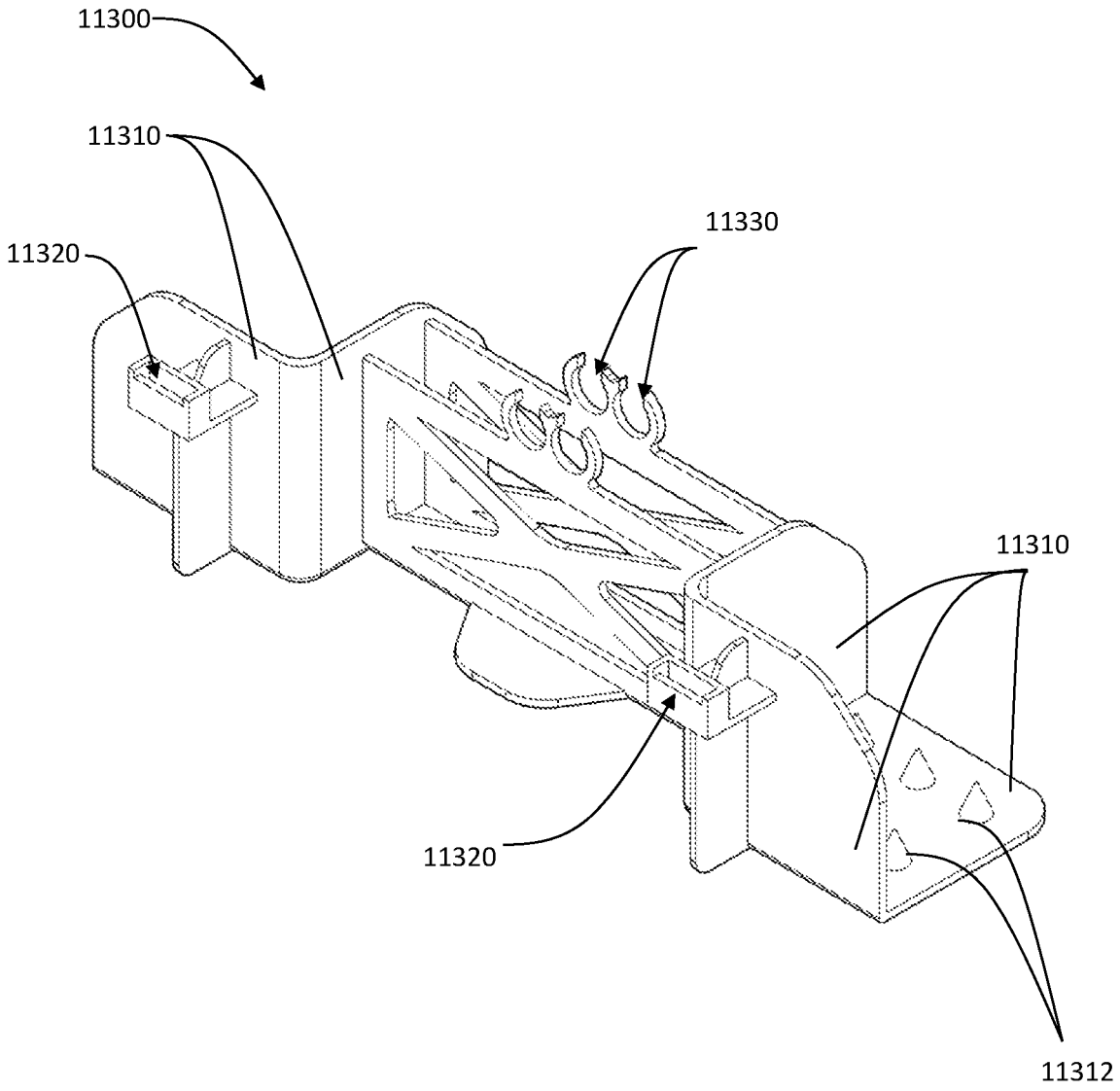
FIG. 16 shows a side front perspective view of the pod base securing arrangement of FIG. 15.
Figure 17:
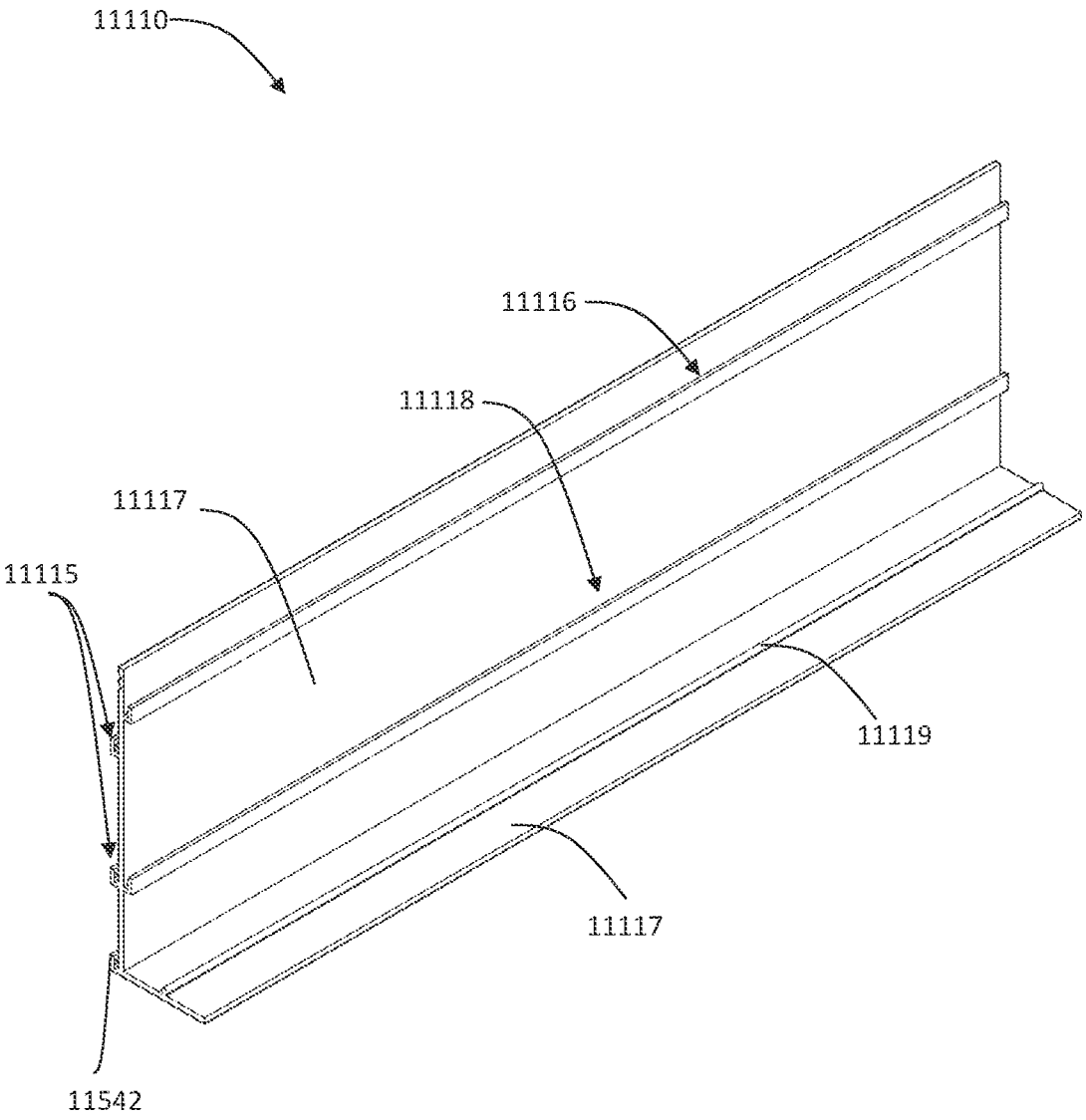
FIG. 17 shows a rear side perspective view of a lower side forming member of FIG. 13.
Figure 18:
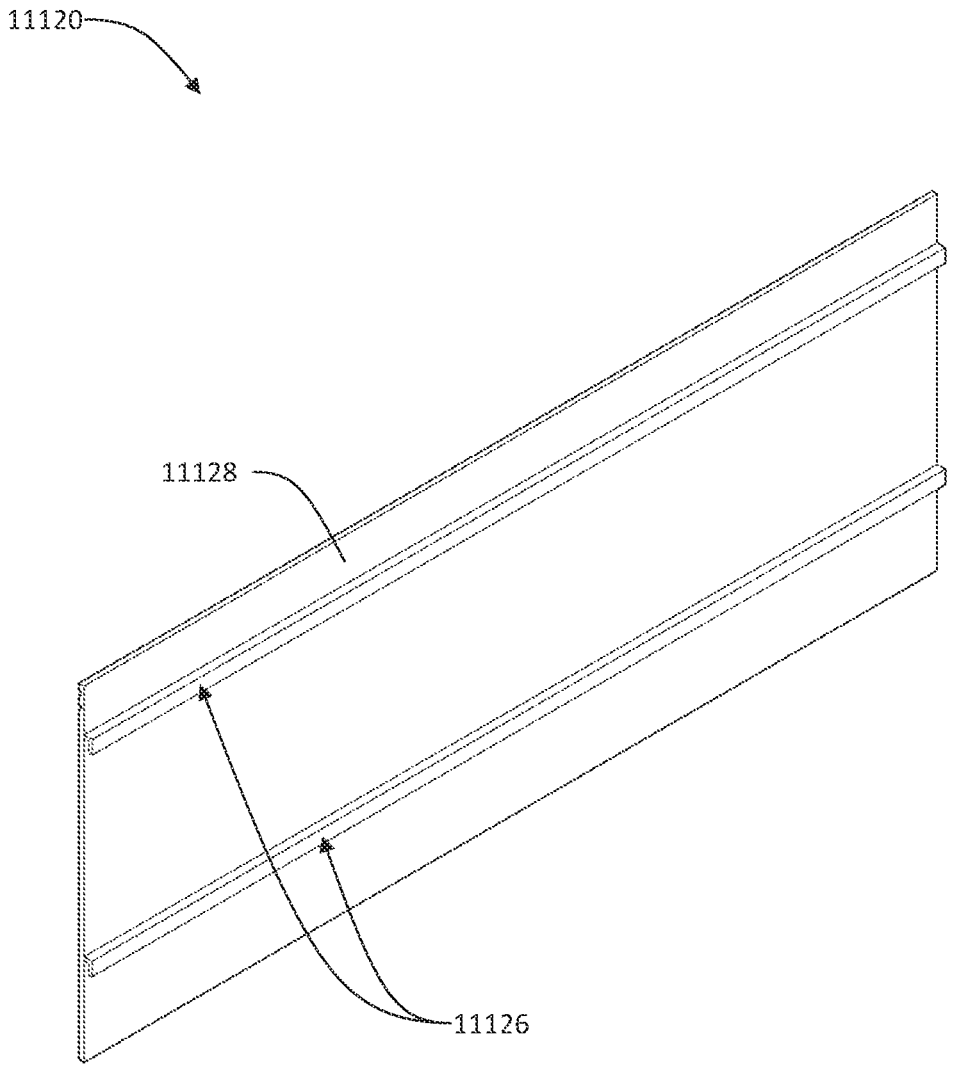
FIG. 18 shows a rear side perspective view of an upper side forming member of FIG. 13.
Figure 19:
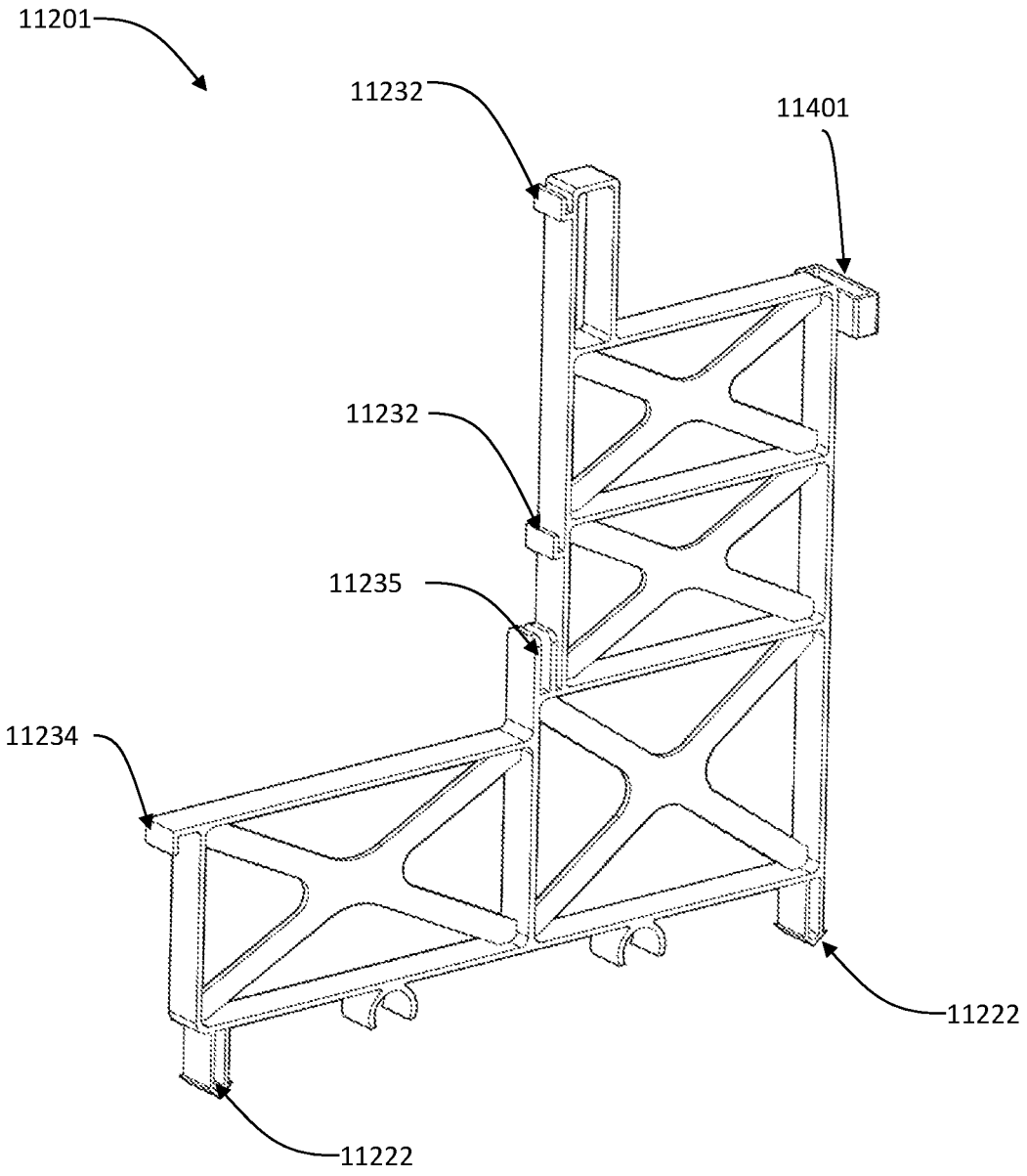
FIG. 19 shows a side front perspective view of an upper connector of FIG. 13.
Figure 20:
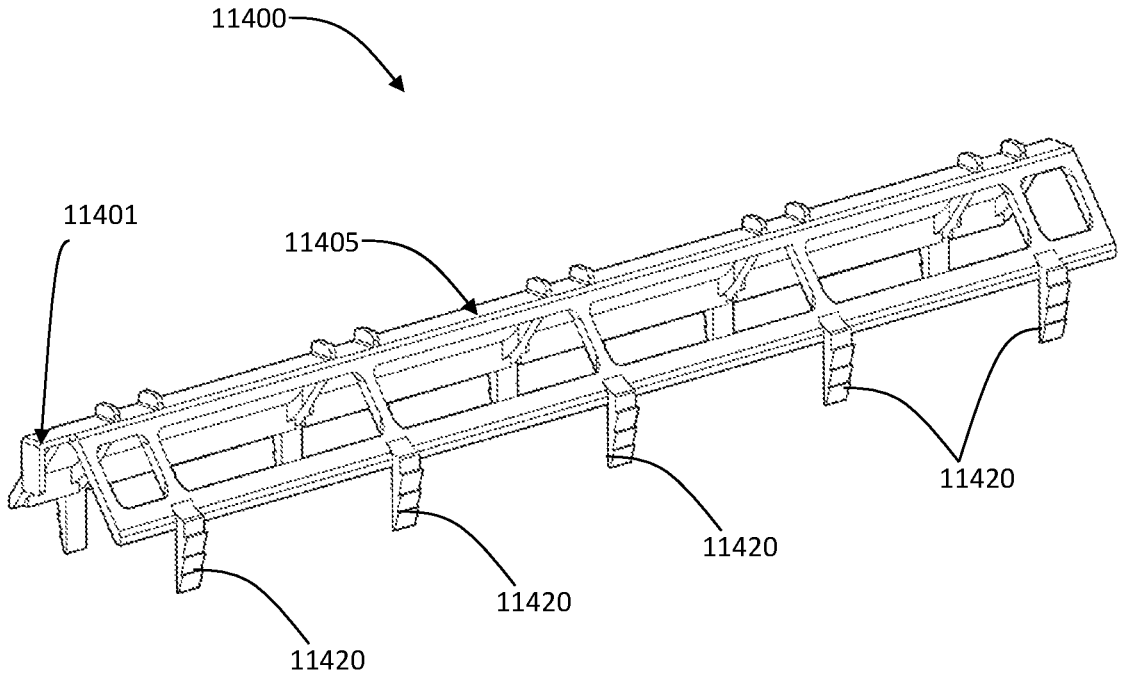
FIG. 20 shows a side front perspective view of a pod top securing arrangement of FIG. 13.
Figure 21:
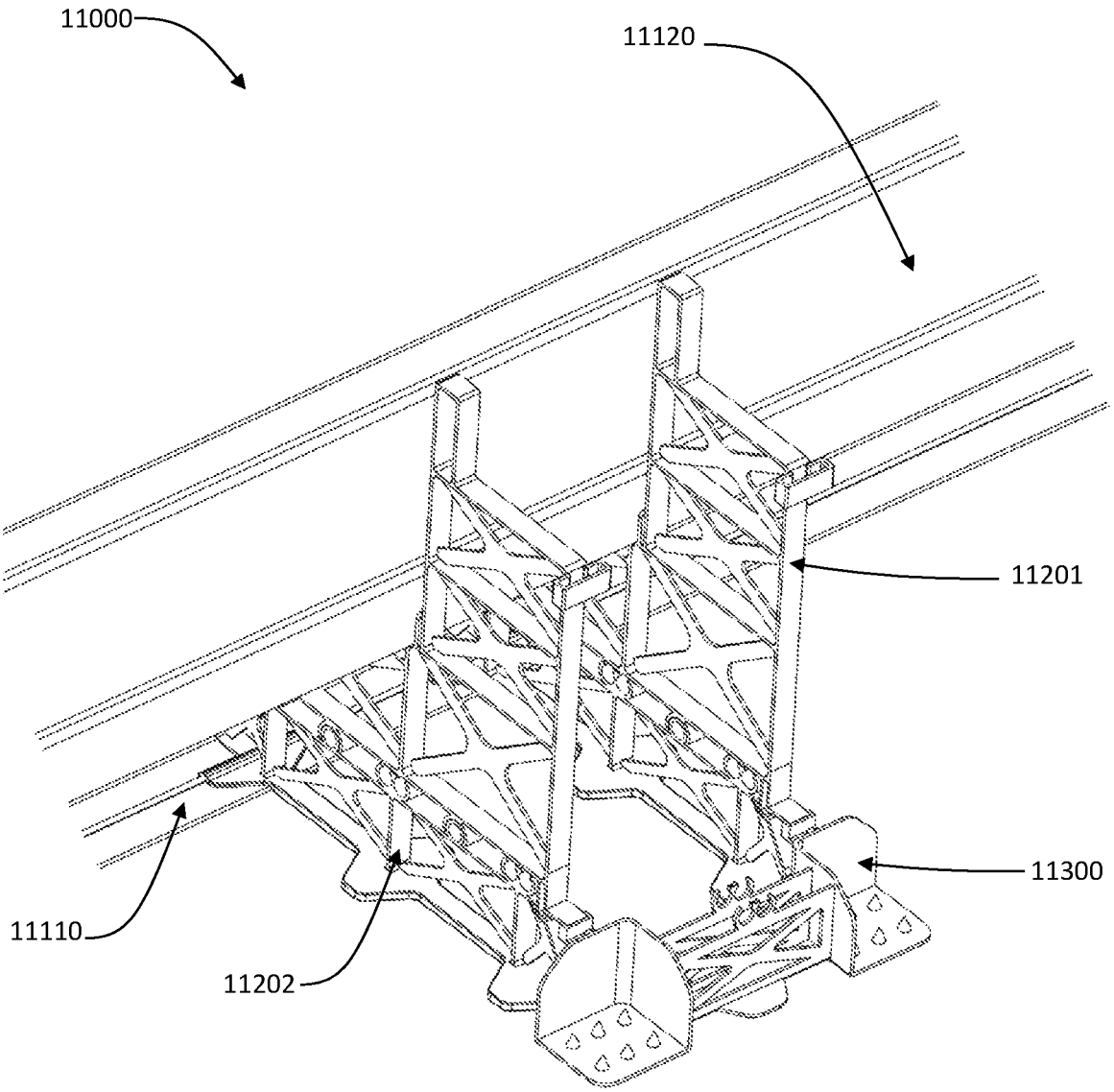
FIG. 21 shows a top rear perspective view of the foundation forming arrangement of FIG. 13 with the forming pods removed.
Figure 22:
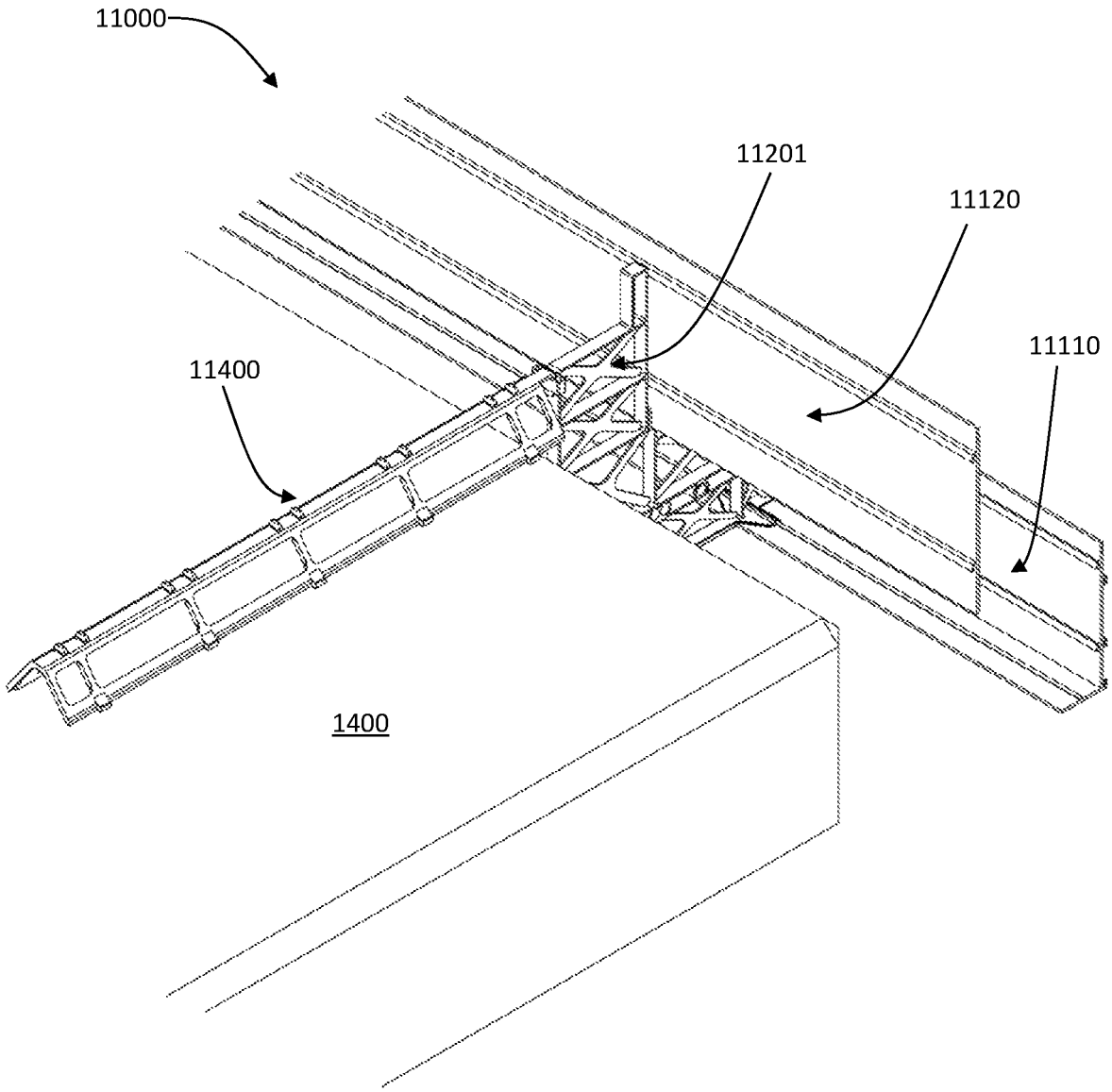
FIG. 22 shows a top rear perspective view of the foundation forming arrangement of FIG. 13.

The foundation forming arrangement 11000 further includes a pod base securing arrangement 11300 (shown in FIGS. 13, 15 and 16) and a pod top securing arrangement 11400 (shown in FIGS. 13, 20 and 22). The pod base securing arrangement 11300 includes similar features to the connector shown in FIG. 11, in that it is configured for extending under and abutting against the corners of a pair of adjacent forming pods 1400, in order to properly space apart the adjacent forming pods, as well as to prevent movement of the foundation forming arrangement relative to the forming pods 1400.

The pod base securing arrangement 11300 includes two sets of three walls or flanges 11310, with the flanges extending at right angles to each other to define an internal corner into which a corner of the forming pod is received. The horizontally extending flange includes spikes 11312 onto which polystyrene forming pods maybe pressed to hold them in place.

Lower connector 11202 includes a pair of engaging formations 11212 defining right-angled downwardly extending tabs that are receivable into complementary slots 11320 on pod base securing arrangement 11300. Pod base securing arrangement 11300 further includes bar engaging formations 11330 for engaging with the reinforcing bars 110 extending between adjacent forming pods.

Upper connector 11201 is also configured for engaging with pod top securing arrangement 11400 by means of an engaging arrangement 11410 that includes a downwardly extending right-angled tab that is receivable into a complementary receiving slot.

Pod top securing arrangement 11400 (shown in more detail in FIG. 20) includes a substantially elongate body 11405 and barb formations 11420 spaced regularly along its length. Barb formations 11420 can be pushed into a top surface of forming pods 1400 to secure pod top securing arrangement in place.

The lower connector 11202 further includes a clipping formation in the form of a channel 11215 which can be clipped over a complementary shaped bead 11119 that extends along the length of horizontal base leg of lower side forming member 11110. It is envisaged that plastic moisture liner sheet 300 will be able to be clamped between the channel 11215 and bead 11119, in order to retain it in place and prevented from moving while the foundation slab is being poured. In addition, it is envisaged that a line of double sided tape may be attached between the horizontal base leg of lower side forming member 11110 and the plastic moisture liner sheet in order to facilitate it remaining in place.

Figure 23:
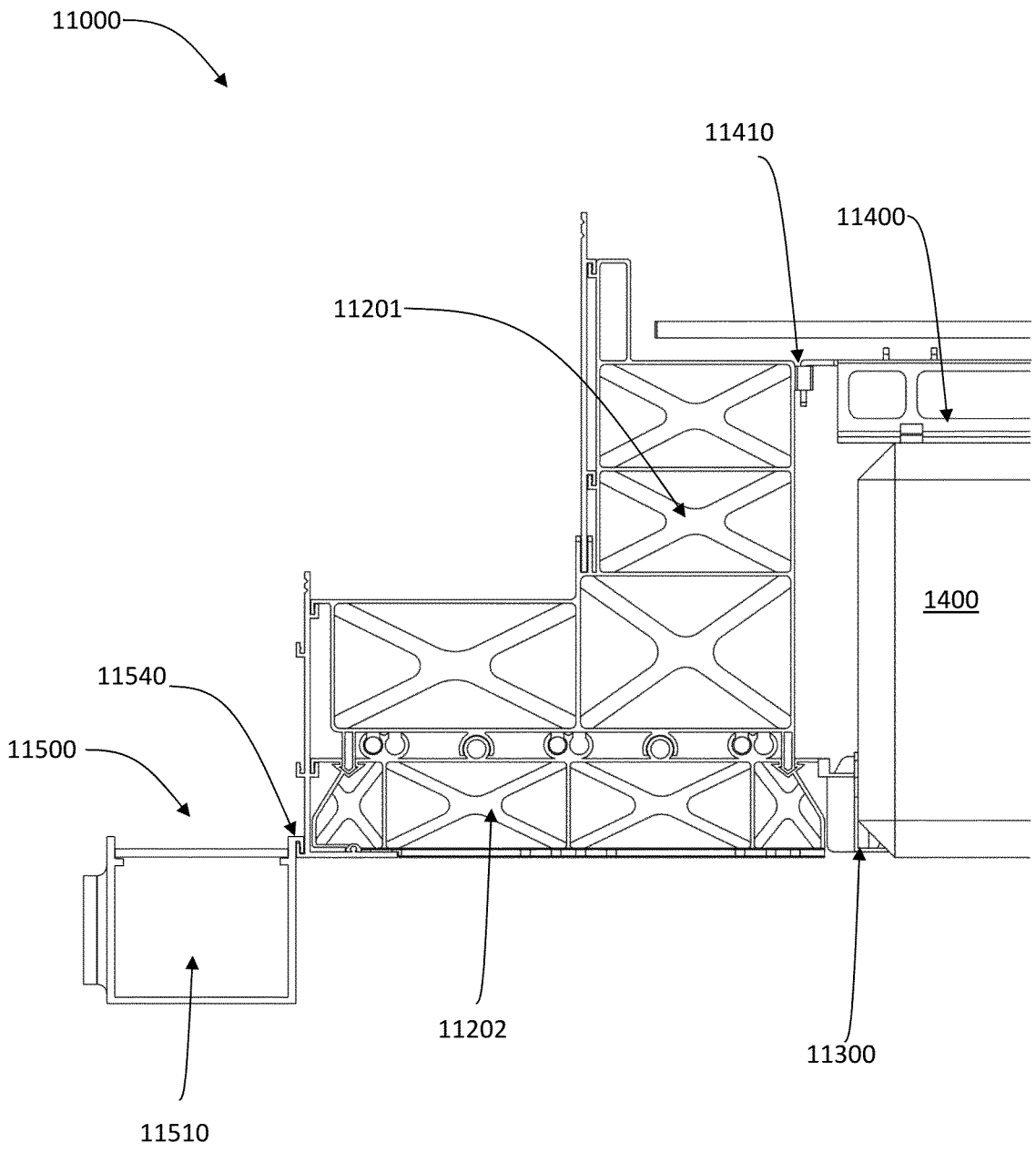
FIG. 23 shows a side elevation view of the foundation forming arrangement of FIG. 13 with a drain attached.
Figure 24:
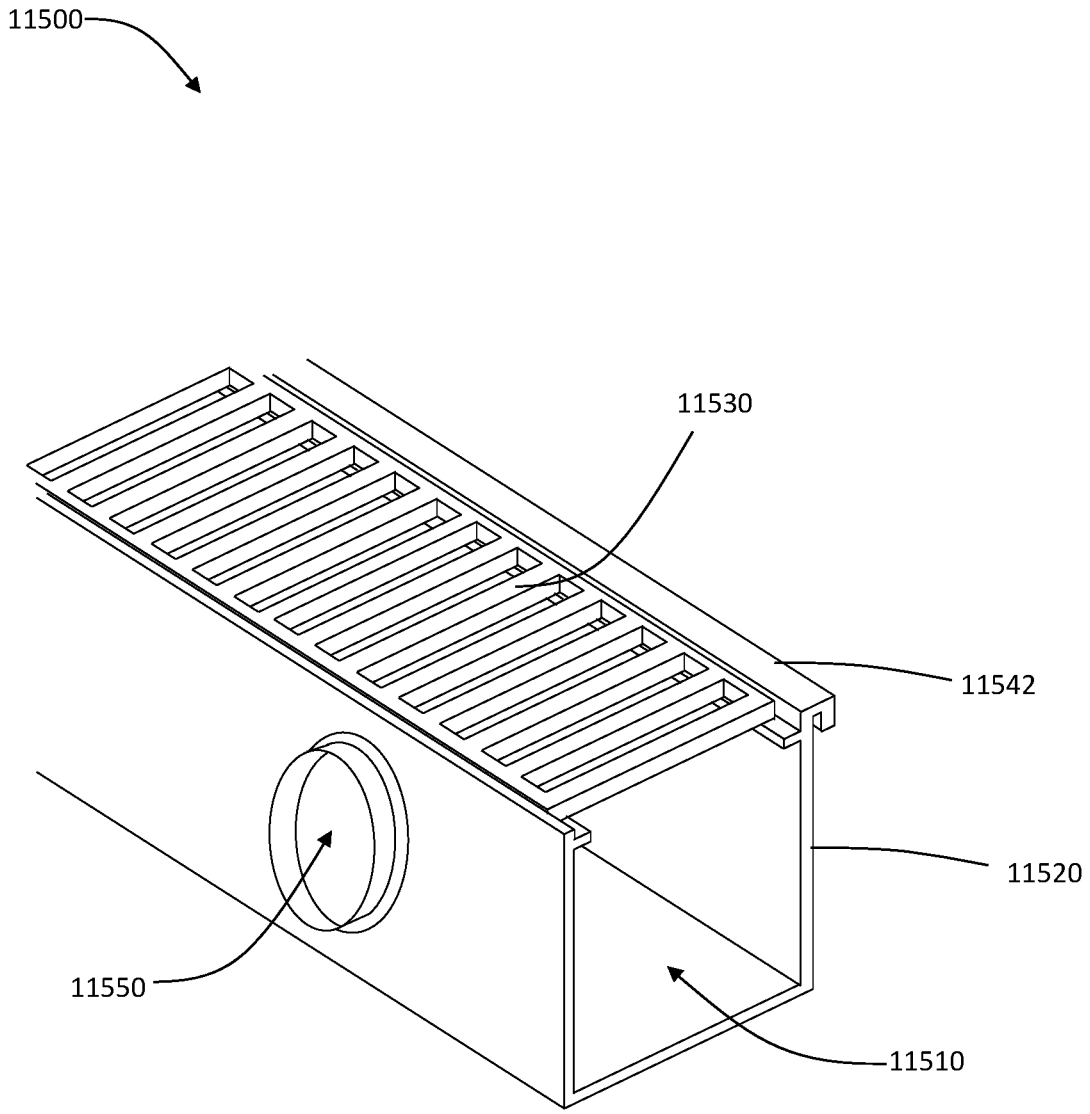
FIG. 24 shows a side top front perspective view of a drain of FIG. 23.

Now as shown in FIGS. 23 and 24, it is envisaged that the foundation forming arrangement 11000 may be provided with a drain 11500. The drain 11500 defines a drainage passage 11510 for diverting groundwater away from the foundation slab. Preferably the drain 11500 is configured for being connected to a stormwater drain pipe to this end. The drain 11500 includes a U-shaped drainage channel 11520 for guiding the passage of water and a grate 11530 configured to be located over the mouth of the drainage channel 11522 and configured for filtering groundwater from the surrounding soil. It is envisaged that the grate 11530 will preferably be removably attachable to the drainage channel, although it is envisaged that it may also be integrally formed or permanently attached.

The drain 11500 is configured for being connected to the lower side forming member 11110, although it is envisaged that it may also be connected to the lower connector 11202. The drain 11500 is preferably removably connectable to the lower side forming member by a snap fit type connecting arrangement 11540 including interengaging right angled protrusions 11542 forming slots on both the drain 11500 and the lower side forming member 11110.

It should be noted that all of the right angled protrusions and/or tabs and/or slots shown for connecting the various items of the foundation forming item together preferably include barb type formations at their distal ends that allow the ends of the protrusion to be inserted into complementary slots of similar right-angled protrusions.

The drain 11500 is preferably configured to flow into a stormwater drain, and to this end it includes a stormwater connection outlet 115550, preferably located on a side of the drainage channel.

Figure 25:
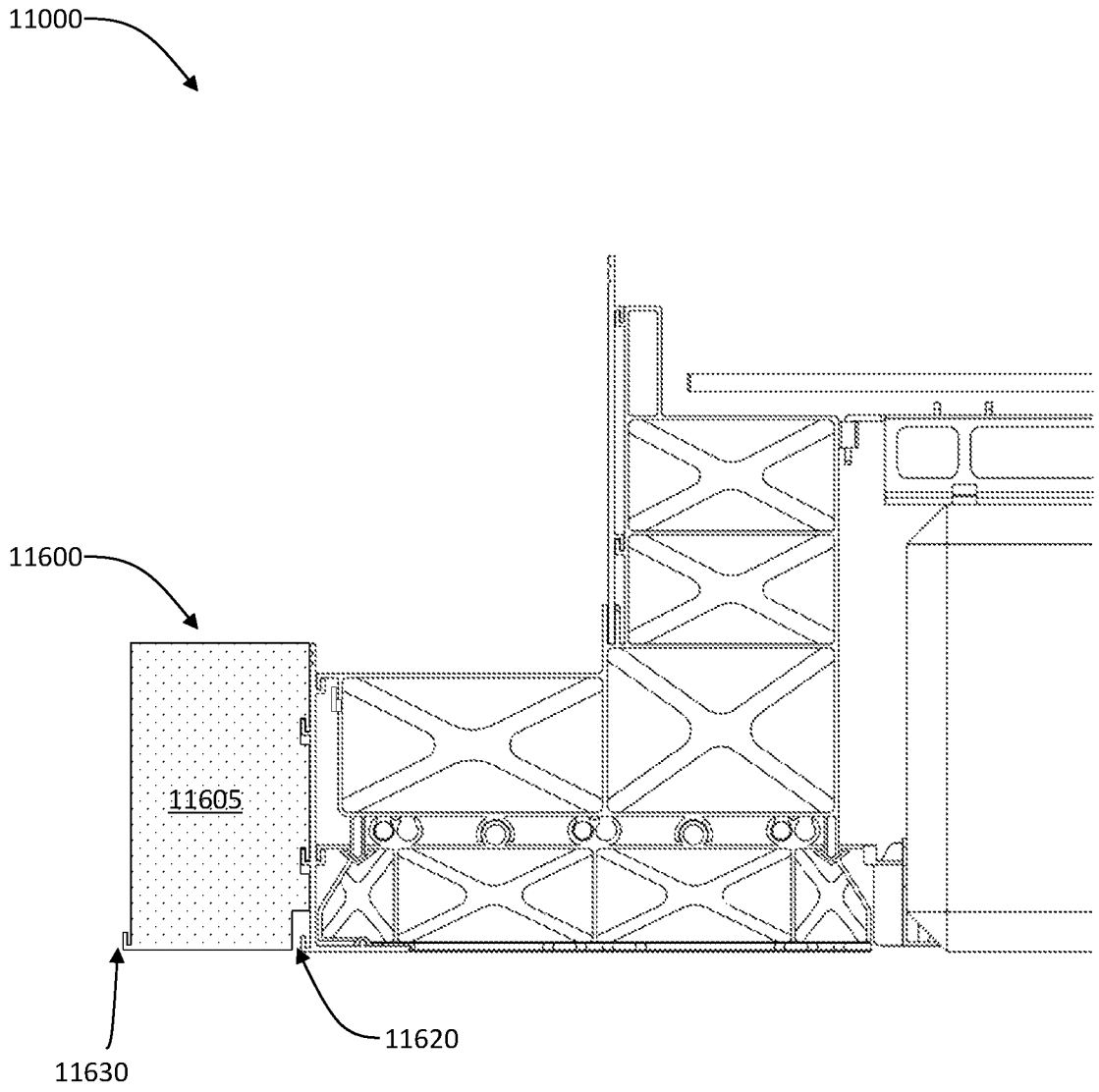
FIG. 25 shows a side elevation view of the foundation forming arrangement of FIG. 13 with an insulative panel attached.
Figure 26:
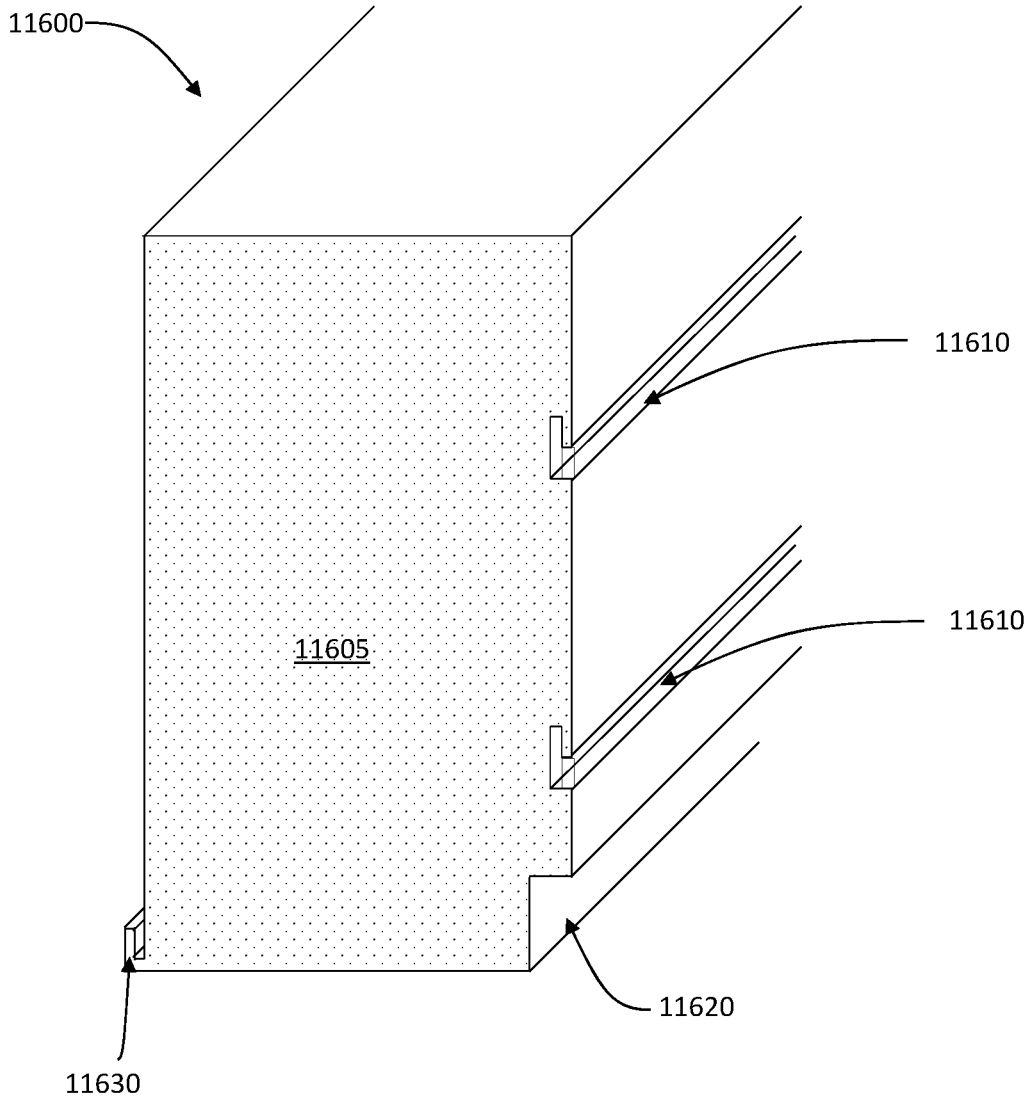
FIG. 26 shows a top side rear perspective view of an insulative panel of FIG. 25.

Further, and as shown in FIGS. 25 and 26, the foundation forming arrangement 11000 can include an insulative panel 11600. The insulative panel 11600 is preferably configured for insulating the side of the foundation slab in operation. The insulative panel 11600 is preferably sacrificial in that it will remain in place after pouring of the foundation slab. The insulative panel includes a body 11605 is preferably composed of an insulative material. The insulative material may include, but not be limited to one or more selected from expanded foam, plastic, timber, and any other suitable material.

The insulative panel 11600 preferably includes slots into which engaging formations in the form of right-angled protrusions 11115 extending along the length of the outside of the lower side forming member 11110 may be received. Insulative panel 11600 further includes a recess 11620 whereby the snap fit type correct connector arrangement 11540 connecting the drain 11500 to the lower side forming member can be accommodated. The insulative panel 11600 also provides similar right-angled protrusions 11630 to the lower side forming member to allow the drain 11500 to be connected to the outside of the insulative panel 11600.

The insulative panel can in an alternative embodiment (not shown) be integrally formed with one or both of the upper side forming member and the lower side forming member.

It should also be noted that, while the connectors are shown in the figures as connecting the side forming members to the forming pods at the corner of the forming pods, it is also envisaged that the connectors may be configured for connecting the forming pods towards a central part of their length to the side forming members.

In Use

In use, it is anticipated that initially the periphery of the foundation slab will be marked out. Where a sunken foundation slab is required, this will initially be installed. The reinforcing steel work and forming pods (if required) will then be laid out. Where the reinforcing steel work is to be supported on a connector the connector will be provided, the connectors connected to the forming pods (where this is a possibility) and/or spacing the forming pods correctly, and the reinforcing bars engaged with and/or connected to the connectors. At the same time, the side forming members will be provided and connected to the connectors. The reinforcing steel work will then be wired-up to connect the reinforcing bars rigidly to each other. In this way, and the required distances and depths of the reinforcing steel work may be accurately gauged. Insertion of upper side forming members into upper side member connecting formations of the connector may be carried out after the wiring up of the reinforcing bars to each other.

The concrete slurry is then poured into the area, where the side forming members serve to form the sides of the foundation slab. Once the concrete slurry has set, removable portions may be removed from the side forming members and/or the connectors by breaking them at the frangible zones of engineered weakness.

Interpretation

Markush Groups

In addition, where features or aspects of the invention are described in terms of Markush groups, those skilled in the art will recognise that the invention is also thereby described in terms of any individual member or subgroup of members of the Markush group.

Chronological Sequence

For the purpose of this specification, where method steps are described in sequence, the sequence does not necessarily mean that the steps are to be carried out in chronological order in that sequence, unless there is no other logical manner of interpreting the sequence.

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

For the purposes of this specification, the term "plastic" shall be construed to mean a general term for a wide range of synthetic or semisynthetic polymerization products, and generally consisting of a hydrocarbon-based polymer.

As used herein the term "and/or" means "and" or "or", or both.

As used herein "(s)" following a noun means the plural and/or singular forms of the noun.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the construction industries.

The invention claimed is:

1. A foundation forming arrangement for forming a side of a foundation slab, the foundation forming arrangement comprising:

a lower connector comprising:

one or more sidewall engagement portions for engaging with a lower sidewall forming member;

one or more reinforcement bar engagement portions adapted to receive one or more reinforcement bars from above the lower connector; and one or more upper connector engagement portions;

an upper connector comprising:

one or more lower connector engagement portions configured for engagement with the one or more upper connector engagement portions of the lower connector;

one or more sidewall engagement portions for engaging with an upper sidewall forming member;

the foundation forming arrangement being such that, in use, (i) the one or more sidewall engagement portions of the lower connector are engaged with the lower sidewall forming member;

(ii) one or more reinforcement bars are placed from above and engaged with the one or more reinforcement bar engagement portions;

(iii) the one or more lower connector engagement portions of the upper connector are engaged with the one or more upper connector engagement portions of the lower connector such that the one or more reinforcement bars are looped by the lower connector connected to the upper connector; and (iv) the one or more sidewall engagement portions of the upper connector are engaged with the upper sidewall forming member.

2. The foundation forming arrangement of claim 1, further comprising one or more forming pods configured for forming voids underneath the concrete slab once it has set.

3. The foundation of forming arrangement of claim 1 further comprising the lower sidewall forming member and the upper sidewall forming member.

4. The foundation forming arrangement of claim 2, wherein the lower connector further comprises a first pod engagement formation adapted for connecting the lower connector to at least one of the one or more forming pods.

5. The foundation forming arrangement of claim 4, wherein the upper connector further comprises a second pod engagement formation adapted for connecting the upper connector to the at least one of the one or more forming pods.

* * * * *